US012613063B2

(12) United States Patent
Lee et al.

(10) Patent No.: US 12,613,063 B2
(45) Date of Patent: Apr. 28, 2026

(54) REFRIGERATOR AND HOME APPLIANCE

(71) Applicant: SAMSUNG ELECTRONICS CO., LTD., Suwon-si (KR)

(72) Inventors: Chomin Lee, Suwon-si (KR); Byoungmok Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 26 days.

(21) Appl. No.: 18/663,639

(22) Filed: May 14, 2024

(65) Prior Publication Data

US 2024/0384921 A1 Nov. 21, 2024

Related U.S. Application Data

(63) Continuation of application No. PCT/KR2024/004064, filed on Mar. 29, 2024.

(30) Foreign Application Priority Data

May 15, 2023 (KR) ..... 10-2023-0062303
Aug. 2, 2023 (KR) ..... 10-2023-0101313

(51) Int. Cl.
*F25D 23/02* (2006.01)

(52) U.S. Cl.
CPC ..... *F25D 23/02* (2013.01); *F25D 2400/18* (2013.01)

(58) Field of Classification Search
None
See application file for complete search history.

(56) References Cited

U.S. PATENT DOCUMENTS 6,209,975 B1 * 4/2001 Lai ..... G06F 1/181 312/265.6
8,857,865 B2 * 10/2014 Im ..... F25D 23/025 292/194
11,339,819 B2 5/2022 Yao et al.
(Continued)

FOREIGN PATENT DOCUMENTS

EP 3 799 616 B1 5/2023
EP 4 174 421 A1 5/2023
(Continued)

OTHER PUBLICATIONS

International Search Report dated Jul. 22, 2024 for International Application No. PCT/KR2024/004064.
(Continued)

*Primary Examiner* — Hanh V Tran
(74) *Attorney, Agent, or Firm* — STAAS & HALSEY LLP

(57) ABSTRACT

A refrigerator comprise: a door including a body including: a outer plate, and a first and second cap coupled to the outer plate the first cap including an opening providing entry to a space in the first cap, a door panel detachably mountable on the body, and including: a panel, and a first and second trim, and a fixer on the first cap and rotatable between unlocked and locked positions. The body, the door panel, and the fixer configured so that, to mount the door panel on the body: the second trim is coupled to the second cap and the fixer is in the unlocked position, the first trim is passed through the opening into the space and, while being inserted into the space, the first trim presses, thereby rotating, the fixer to the locked position, so that the fixer is coupled to the first trim.

15 Claims, 32 Drawing Sheets

(56) References Cited

U.S. PATENT DOCUMENTS

| | | | | |
|---|---|---|---|---|
| 11,796,243 | B2 | 10/2023 | Park et al. | |
| 11,867,450 | B2 | 1/2024 | Lee et al. | |
| 11,959,691 | B2 | 4/2024 | Kwon et al. | |
| 2008/0250605 | A1 | 10/2008 | Park | |
| 2012/0169196 | A1 | 7/2012 | Marchetti | |
| 2021/0055038 | A1* | 2/2021 | Lee | F25C 5/22 |
| 2021/0396456 | A1* | 12/2021 | Park | F25D 23/10 |
| 2023/0280086 | A1* | 9/2023 | Park | F24C 15/02 312/405 |
| 2023/0384021 | A1 | 11/2023 | Lee et al. | |

FOREIGN PATENT DOCUMENTS

| | | | | |
|---|---|---|---|---|
| JP | 3726076 | B2 | 12/2005 | |
| KR | 0129621 | Y1 | 1/1999 | |
| KR | 20-0168020 | Y1 | 2/2000 | |
| KR | 10-0596530 | B1 | 7/2006 | |
| KR | 10-2008-0092834 | A | 10/2008 | |
| KR | 10-2019-0082894 | A | 7/2019 | |
| KR | 10-2020-0121219 | A | 10/2020 | |
| KR | 10-2322981 | B1 | 11/2021 | |
| KR | 10-2022-0030129 | A | 3/2022 | |
| KR | 10-2022-0068121 | A | 5/2022 | |
| KR | 20220068121 | A * | 5/2022 | F24C 15/02 |
| KR | 10-2023-0008568 | A | 1/2023 | |
| WO | WO-2022033602 | A1 * | 2/2022 | F25D 23/028 |
| WO | WO 2022/108097 | A1 | 5/2022 | |

OTHER PUBLICATIONS

Written Opinion of the International Searching Authority dated Jul. 22, 2024 for International Application No. PCT/KR2024/004064.

* cited by examiner

REFRIGERATOR AND HOME APPLIANCE

CROSS-REFERENCE TO RELATED APPLICATIONS

This is a continuation application of International Application PCT/KR2024/004064, filed Mar. 29, 2024, which is incorporated herein by reference in its entirety, it being further noted that foreign priority benefit is based upon Korean Patent Application Nos. 10-2023-0062303, filed May 15, 2023 and 10-2023-0101313, filed Aug. 2, 2023, which are incorporated by reference herein in their entireties.

TECHNICAL FIELD

The present disclosure relates to a refrigerator and a home appliance, and more particularly to a refrigerator and a home appliance including an improved door structure.

BACKGROUND ART

A home appliance may be equipped with a main body including a storage compartment and a door configured to open and close the storage compartment. For example, a refrigerator may keep food fresh by being equipped with a main body including a storage compartment, a cold air supply device configured to supply cold air to the storage compartment, and a door configured to open and close the storage compartment.

The storage compartment includes a refrigerating compartment maintained at approximately 0 to 5° C. to store food in a refrigerated manner, and a freezing compartment maintained at approximately 0 to −30° C. to store food in a frozen manner. The front of the storage compartment is open for the loading and unloading of goods, and the storage compartment may be opened and closed by the door.

The door may include a door body including an insulation material, and a door panel configured to be detachably coupled to the front of the door body. Accordingly, a user can select one of door panels of various materials, colors, or designs according to his/her taste and attach the selected panel to the door body, and replace the door panel coupled to the door body with another door panel.

DISCLOSURE

Technical Problem

The present disclosure is directed to providing a refrigerator and a home appliance including a door including a door panel configured to be detachably coupled to a door body.

Further, the present disclosure is directed to providing a refrigerator and a home appliance capable of easily coupling a door panel to a door body or capable of easily separating the door panel from the door body.

Further, the present disclosure is directed to providing a refrigerator and a home appliance capable of coupling a door panel to a door body or capable of separating the door panel from the door body without using a separate tool.

Further, the present disclosure is directed to providing a refrigerator and a home appliance with easy management of components during manufacturing and use of the refrigerator and home appliance.

Further, the present disclosure is directed to providing a refrigerator and a home appliance capable of stably coupling a door panel and a door body to each other.

Technical Solution

One aspect of the present disclosure can include a refrigerator including a main body including a storage compartment; and a door to open and close the storage compartment. The door can include a door body including a door outer plate, a door inner plate, a first cap coupled a first end of the door outer plate, and including a front opening in a front portion of the first cap providing an entry to an accommodating space provided by the first cap, and a second cap coupled to a second end of the door outer plate, a door panel detachably mountable on the door body, and including: a panel, a first trim protruding from a first end of a rear surface of the panel, and a second trim protruding from a second end of the rear surface of the panel, and a fixer on the first cap and rotatable between an unlocked position and a locked position. The door body, the door panel, and the fixer are configured so that, to mount the door panel on the door body: the second trim is couplable to the second cap, and with the second trim coupled to the second cap and the fixer being in the unlocked position, the first trim is passable through the front opening to be inserted into the accommodating space and, while being inserted into the accommodating space, the first trim presses the fixer, thereby rotating the fixer to the locked position, so that the fixer is coupled to the first trim.

The first trim can include a first trim hole, the fixer can include a locking protrusion, and the door body, the door panel, and the fixer can be configured so that, to mount the door panel on the door body: the locking protrusion can be insertable into the first trim hole, and while the locking protrusion is being inserted into the first trim hole, the fixer can become coupled to the first trim.

The second trim can include a second trim hole, the second cap can include a cap protrusion, and the door body, the door panel, and the fixer can be configured so that, to mount the door panel on the door body: the cap protrusion can be insertable into the second trim hole, and the second trim can become coupled to the second cap as the cap protrusion is inserted into the second trim hole.

The fixer can comprise an arm, and the door body, the door panel, and the fixer can be configured so that, to mount the door panel on the door body: the first trim can press the arm while being inserted into the accommodating space, thereby rotating the fixer to the locked position, so that the fixer is coupled to the first trim, and to separate the door panel from the door body: the fixer can be rotatable from the locked position to the unlocked position to cause the arm to press the first trim, thereby removing the first trim from being accommodated in the accommodating space, so that the fixer can become decoupled from the first trim and the door panel can thereby be separated from the door body.

The fixer can include rotation protrusions to form a rotation axis of the fixer, the rotation axis can be formed along a left and right direction of the door body, and the fixer can rotate about the rotation axis when the fixer is rotated between the locked position and the unlocked position.

The fixer can include a position fixing protrusion, and the first cap can include: a locking hole, and an unlocking hole, the position fixing protrusion can be configured to be: movable into the unlocking hole to fix the fixer in the unlocked position, and movable into the locking hole to fix the fixer in the locked position, and the door body, the door panel, and the fixer can be configured so that, to mount the door panel on the door body: the position fixing protrusion can be moved into the unlocking hole to fix the fixer in the unlocked position before the first trim presses the fixer.

The first cap can include a guide passage, and the door body, the door panel, and the fixer can be configured so that, to mount the door panel on the door body: a movement of the position fixing protrusion can be guided along the guide passage while the first trim presses the fixer and the fixer is rotated from the unlocked position to the locked position.

The position fixing protrusion can include a plurality of elastic parts along a circumferential direction of the position fixing protrusion, and a plurality of slits arranged so that each slit of the plurality of slits is between adjacent elastic parts of the plurality of elastic parts.

In response to the position fixing protrusion being moved into the guide passage, one or more elastic parts of the plurality of elastic parts can be elastically deformed radially inward; and in response to the position fixing protrusion being moved into the locking hole or the unlocking hole, the one or more elastic parts of the plurality of elastic parts can be elastically restored.

With the second trim coupled to the second cap, the door panel can be configured to rotate between: a tilted position in which the door panel can be tilted with respect to the door body, and an upright position in which the first trim can be inserted into the accommodating space, the fixer can be rotated to the locked position and can be coupled to the first trim, and the door panel can be fixed to the door body.

The door body, the door panel, and the fixer can be configured so that, to mount the door panel on the door body: with the second trim coupled to the second cap and the fixer being in the unlocked position, the door panel can be rotatable from the tilted position to the upright position so that: with the door panel being rotated from the tilted position to the upright position, the first trim can be being inserted into the accommodating space, the first trim can press the fixer, thereby rotating the fixer to the locked position, so that the fixer can become coupled to the first trim.

The door body, the door panel, and the fixer can be configured so that, to separate the door panel from the door body: with the second trim coupled to the second cap, the fixer can be rotatable from the locked position to the unlocked position so that: with the fixer being rotated from the locked position to the unlocked position, the door panel can be pressed by the fixer, the first trim can be removed from the accommodating space and decoupled from the fixer, and the door panel can be rotated from the upright position to the tilted position.

The first end of the door outer plate can include an upper end portion of the door outer plate, the second end of the door outer plate can include a lower end portion of the door outer plate, the first end of a rear surface of the panel can include an upper end portion of the rear surface of the panel, the second end of a rear surface of the panel can include a lower end portion of the rear surface of the panel, and the fixer can be coupled to the first cap.

The first cap can include a first cap body which can include the front opening and can provide the accommodating space, and a first cap cover can couple to an upper end of the first cap body, and the fixer can be coupled to the first cap cover.

The first end of the door outer plate can include a lower end portion of the door outer plate, the second end of the door outer plate can include an upper end portion of the door outer plate, the first end of a rear surface of the panel can include a lower end portion of the rear surface of the panel, and the second end of a rear surface of the panel can include an upper end portion of the rear surface of the panel, and the fixer can be coupled to the first cap.

Another aspect of the present disclosure can include a refrigerator including a main body including a storage compartment; and a door configured to open and close the storage compartment. The door can include a door body including an upper cap and a lower cap including a lower cap protrusion; a door panel configured to be detachably coupled to a front surface of the door body, and including an upper trim and a lower trim; a fixer disposed on the upper cap to be rotatable between an unlocked position and a locked position; and an elastic member configured to elastically bias the fixer to the locked position.

The lower trim can be coupled to the lower cap protrusion and can allow the door panel to be tilted with respect to the door body.

The door panel can be configured to rotate between a tilted position in which the lower trim can be coupled to the lower cap protrusion and the door panel can be tilted with respect to the door body, and an upright position in which the lower trim can be coupled to the lower cap protrusion and the door panel can be upright to be parallel to the door body.

Another aspect of the present disclosure can include a refrigerator including a main body including a storage compartment; and a door configured to open and close the storage compartment. The door can include a door body including an upper cap and a lower cap; a door panel configured to be detachably coupled to a front surface of the door body, and including an upper trim and a lower trim configured to be coupled to the lower cap; and a fixer disposed on the upper cap to be rotatable between a locked position coupled to the upper trim and an unlocked position disengaged from the upper trim.

The fixer can include a position fixing protrusion configured to be coupled to a locking hole formed in the upper cap to allow the fixer to be fixed to the locked position.

Advantageous Effects

It may be easy to mount a door panel to a door body and to replace the door panel.

Further, it may be easy to manage components during the manufacturing and use of a refrigerator.

Further, a door panel and a door body may be stably coupled to each other.

MODES OF THE INVENTION

Figure 1:
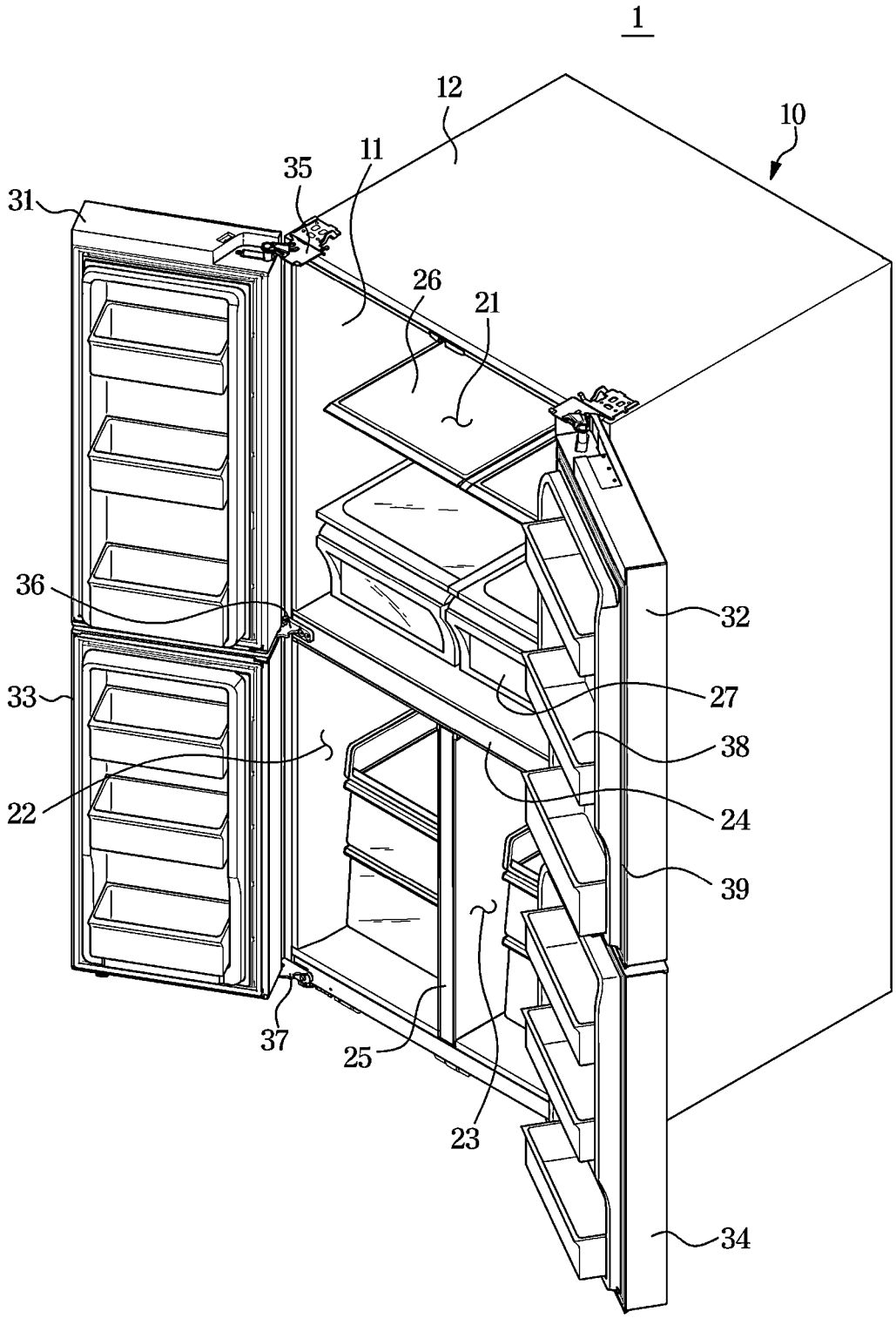
FIG. 1 is a view of a refrigerator according to one embodiment of the present disclosure.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this document, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "1st", "2nd", "first", or "second" may be used simply to distinguish a component from other components, without limiting the component in other aspects (e.g., importance or order).

Further, as used in the disclosure, the terms "front", "rear", "top", "bottom", "side", "left", "right", "upper", "lower", and the like are defined with reference to the drawings, and are not intended to limit the shape and position of each component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the disclosure may include a main body.

The main body may include an insulation.

The insulation may insulate inside of a storage room from outside of the storage room to maintain inside temperature of the storage room at appropriate temperature without being influenced by an external environment of the storage room. According to an embodiment of the disclosure, the insulation may include a foaming insulation such as a polyurethane foam.

According to an embodiment of the disclosure, the insulation may include a vacuum insulation in addition to a foaming insulation, or may be configured only with a vacuum insulation instead of a forming insulation.

The storage room may store a variety of items, such as foods, medicines, cosmetics, and the like, and the storage room may be formed to be open on at least one side for storing or removing items.

The refrigerator may include one or more storage rooms. In a case in which two or more storage rooms are formed in the refrigerator, the respective storage rooms may have different purposes of use, and may be maintained at different temperature. To this end, the storage rooms may be partitioned by a partition wall including an insulation.

The storage room may be maintained within an appropriate temperature range according to a purpose of use, and include a "refrigerating room", a "freezing room", and a "temperature conversion room" according to purposes of use and/or temperature ranges. The refrigerating room may be maintained at appropriate temperature to keep food refrigerating, and the freezing room may be maintained at appropriate temperature to keep food frozen. The "refrigerating" may be keeping food cold without freezing the food, and for example, the refrigerating room may be maintained within a range of 0 degrees Celsius to 7 degrees Celsius. The "freezing" may be freezing food or keeping food frozen, and for example, the freezing room may be maintained within a range of −20 degrees Celsius to −1 degrees Celsius. The temperature conversion room may be used as any one of a refrigerating room or a freezing room according to or regardless of a user's selection.

The storage room may also be called various other terms, such as "vegetable room", "freshness room", "cooling room", and "ice-making room", in addition to "refrigerating room", "freezing room", and "temperature conversion room", and the terms, such as "refrigerating room", "freezing room", "temperature conversion room", etc., as used below need to be understood to represent storage rooms having the corresponding purposes of use and the corresponding temperature ranges.

The refrigerator according to an embodiment of the disclosure may include at least one door configured to open or close the open side of the storage room. The respective doors may be provided to open and close one or more storage rooms, or a single door may be provided to open and close a plurality of storage rooms. The door may be rotatably or slidably mounted on the front of the main body.

The door may seal the storage room in a closed state. The door may include an insulation, like the main body, to insulate the storage room in the closed state.

According to an embodiment, the door may include an outer door plate forming the front surface of the door, an inner door plate forming the rear surface of the door and facing the storage room, an upper cap, a lower cap, and a door insulation provided therein.

A gasket may be provided on the edge of the inner door plate to seal the storage room by coming into close contact with the front surface of the main body when the door is closed. The inner door plate may include a dyke that protrudes rearward to allow a door basket for storing items to be fitted.

According to an embodiment, the door may include a door body and a front panel that is detachably coupled to the front of the door body and forms the front surface of the door. The door body may include an outer door plate that forms the front surface of the door body, an inner door plate that forms the rear surface of the door body and faces the storage room, an upper cap, a lower cap, and a door insulator provided therein.

The refrigerator may be classified as French Door Type, Side-by-side Type, Bottom Mounted Freezer (BMF), Top Mounted Freezer (TMF), or One Door Refrigerator depending on the arrangement of the doors and the storage rooms.

The refrigerator according to an embodiment of the disclosure may include a cold air supply device for supplying cold air to the storage room.

The cold air supply device may include a machine, an apparatus, an electronic device, and/or a combination system thereof, capable of generating cold air and guiding the cold air to cool the storage room.

According to an embodiment of the disclosure, the cold air supply device may generate cold air through a cooling cycle including compression, condensation, expansion, and evaporation processes of refrigerants. To this end, the cold air supply device may include a cooling cycle device having a compressor, a condenser, an expander, and an evaporator to drive the cooling cycle. According to an embodiment of the disclosure, the cold air supply device may include a semiconductor such as a thermoelectric element. The thermoelectric element may cool the storage room by heating and cooling actions through the Peltier effect.

The refrigerator according to an embodiment of the disclosure may include a machine room where at least some components belonging to the cold air supply device are installed.

The machine room may be partitioned and insulated from the storage room to prevent heat generated from the components installed in the machine room from being transferred to the storage room. To dissipate heat from the components installed inside the machine room, the machine room may communicate with outside of the main body.

The refrigerator according to an embodiment of the disclosure may include a dispenser provided on the door to provide water and/or ice. The dispenser may be provided on the door to allow access by the user without opening the door.

The refrigerator according to an embodiment of the disclosure may include an ice-making device that produces ice. The ice-making device may include an ice-making tray that stores water, an ice-moving device that separates ice from the ice-making tray, and an ice-bucket that stores ice generated in the ice-making tray.

The refrigerator according to an embodiment of the disclosure may include a controller for controlling the refrigerator.

The controller may include a memory for storing and/or memorizing data and/or programs for controlling the refrigerator, and a processor for outputting control signals for controlling the cold air supply device, etc. according to the programs and/or data memorized in the memory.

The memory may store or record various information, data, commands, programs, and the like necessary for operations of the refrigerator. The memory may store temporary data generated while generating control signals for controlling components included in the refrigerator. The memory may include at least one of volatile memory or non-volatile memory, or a combination thereof.

The processor may control the overall operation of the refrigerator. The processor may control the components of the refrigerator by executing programs stored in memory. The processor may include a separate neural processing unit (NPU) that performs an operation of an artificial intelligence (AI) model. In addition, the processor may include a central processing unit (CPU), a graphics processor (GPU), and the like. The processor may generate a control signal to control the operation of the cold air supply device. For example, the processor may receive temperature information of the storage room from a temperature sensor, and generate a cooling control signal for controlling an operation of the cold air supply device based on the temperature information of the storage room.

Furthermore, the processor may process a user input of a user interface and control an operation of the user interface according to the programs and/or data memorized/stored in the memory. The user interface may be provided using an input interface and an output interface. The processor may receive the user input from the user interface. In addition, the processor may transmit a display control signal and image data for displaying an image on the user interface to the user interface in response to the user input.

The processor and memory may be provided integrally or may be provided separately. The processor may include one or more processors. For example, the processor may include a main processor and at least one sub-processor. The memory may include one or more memories.

The refrigerator according to an embodiment of the disclosure may include a processor and a memory for controlling all the components included in the refrigerator, and may include a plurality of processors and a plurality of memories for individually controlling the components of the refrigerator. For example, the refrigerator may include a processor and a memory for controlling the operation of the cold air supply device according to an output of the temperature sensor. In addition, the refrigerator may be separately equipped with a processor and a memory for controlling the operation of the user interface according to the user input.

A communication module may communicate with external devices, such as servers, mobile devices, and other home appliances via a nearby access point (AP). The AP may connect a local area network (LAN) to which a refrigerator or a user device is connected to a wide area network (WAN) to which a server is connected. The refrigerator or the user device may be connected to the server via the WAN.

The input interface may include keys, a touch screen, a microphone, and the like. The input interface may receive the user input and pass the received user input to the processor.

The output interface may include a display, a speaker, and the like. The output interface may output various notifications, messages, information, and the like generated by the processor.

Hereinafter exemplary embodiments of the present disclosure will be described in detail with reference to the accompanying drawings.

FIG. 1 is a view of a refrigerator according to one embodiment of the present disclosure. Referring to FIG. 1, a refrigerator 1 according to one embodiment may include a main body 10, a storage compartment formed inside the main body 10, a door configured to open and close the storage compartment, and a cold air supplier (not shown) configured to supply cold air to the storage compartment. FIG. 1 illustrates that the refrigerator includes a plurality of storage compartments 21, 22, and 23 and a plurality of doors 31, 32, 33, and 34, but there is no limit in the number of storage compartments and the number of doors. For example, the refrigerator may include a single storage compartment and a single door.

The main body 10 may include an inner case 11 provided to form the storage compartments 21, 22, and 23, an outer case 12 coupled to an outside of the inner case 11 to form an exterior of the main body, and an insulation material (not shown) arranged between the inner case 11 and the outer case 12 to insulate the storage compartments 21, 22, and 23.

The storage compartments 21, 22, and 23 may be partitioned from each other by a horizontal partition 24 and a vertical partition 25. The storage compartments 21, 22, and 23 may be divided into an upper storage compartment 21 and lower storage compartments 22 and 23 by the horizontal partition wall 24, and the lower storage compartments 22 and 23 may be divided into a lower left storage compartment 22 and a lower right storage compartment 23 by the vertical partition 25. A shelf 26 in which items are placed and a storage container 27 in which items are stored may be arranged inside the storage compartment.

The cold air supplier may generate cold air using a refrigeration cycle that compresses, condenses, expands, and evaporates a refrigerant, and the cold air supplier may supply the generated cold air to the storage compartments 21, 22, and 23.

The storage compartment 21 may be opened and closed by a pair of doors 31 and 32. The doors 31 and 32 may be rotatably coupled to the main body 10. The storage compartment 22 may be opened and closed by a door 33, and the door 33 may be rotatably coupled to the main body 10. The storage compartment 23 may be opened and closed by a door 34, and the door 34 may be rotatably coupled to the main body 10. The main body 10 may be provided with hinges 35, 36, and 37 to rotatably couple the doors 31, 32, 33, and 34 to the main body 10. However, according to embodiments, the door may be provided in the form of a drawer configured to slide forward and backward.

A door shelf 38 in which items are stored and a door gasket 39 provided to be in close contact with the front of the main body 10 when the door is closed may be provided on a rear surface of the door. The storage compartment may be sealed as the door gasket 39 is in close contact with the front of the main body 10.

Figure 2:
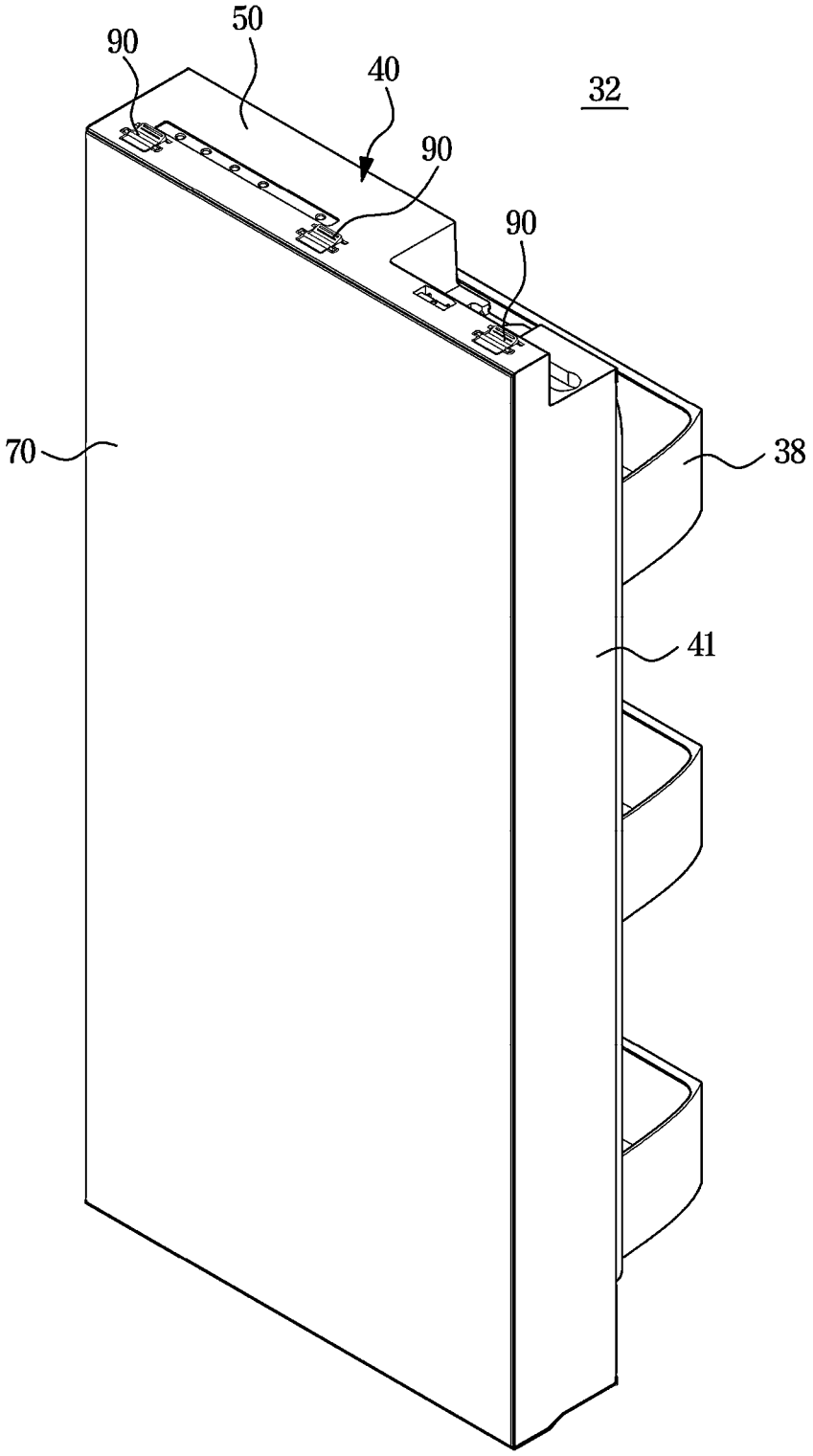
FIG. 2 is a view of a door according to one embodiment of the present disclosure.
Figure 3:
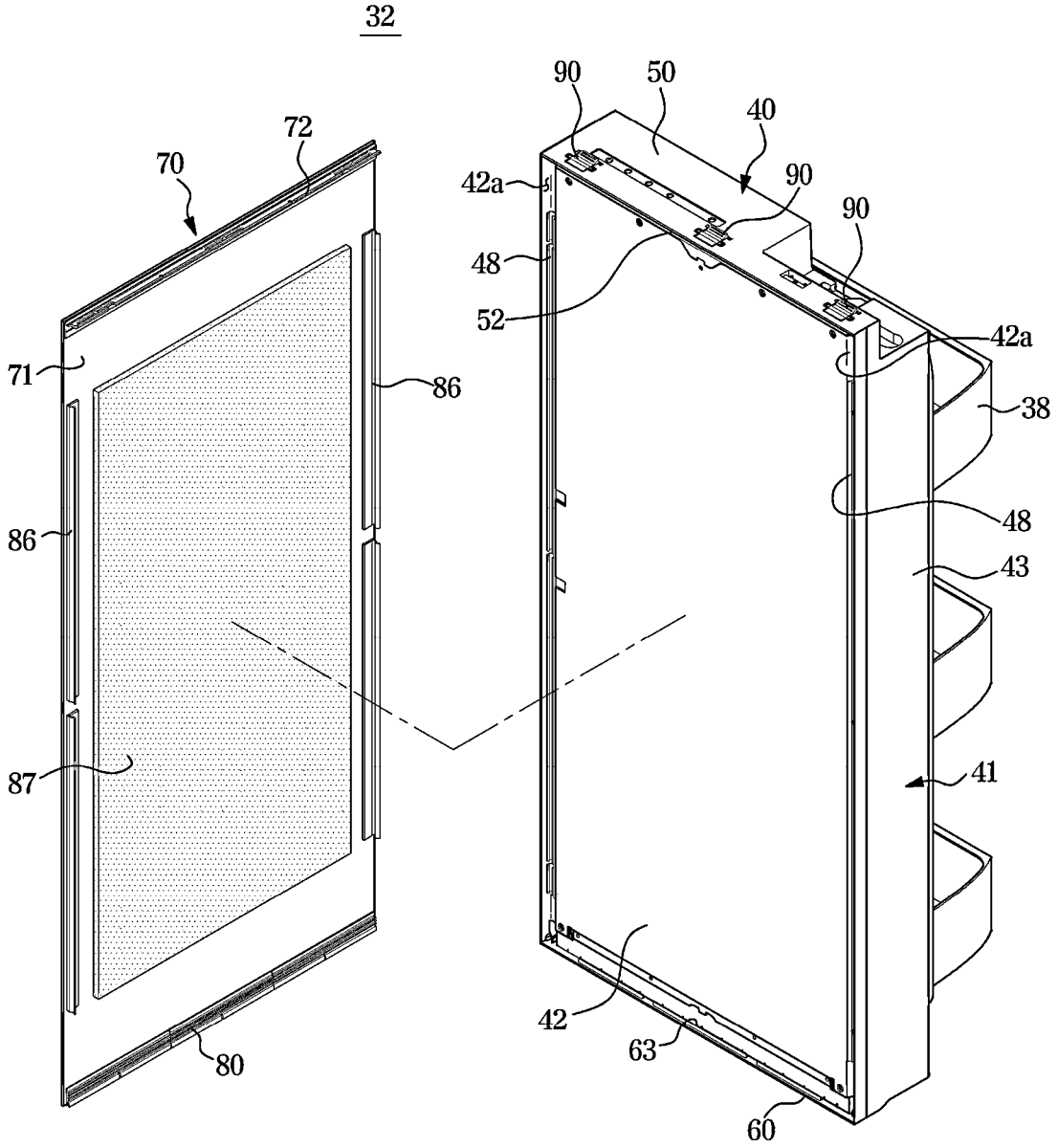
FIG. 3 is a view illustrating a coupling structure of a door body and a door panel according to one embodiment of the present disclosure.
Figure 4:
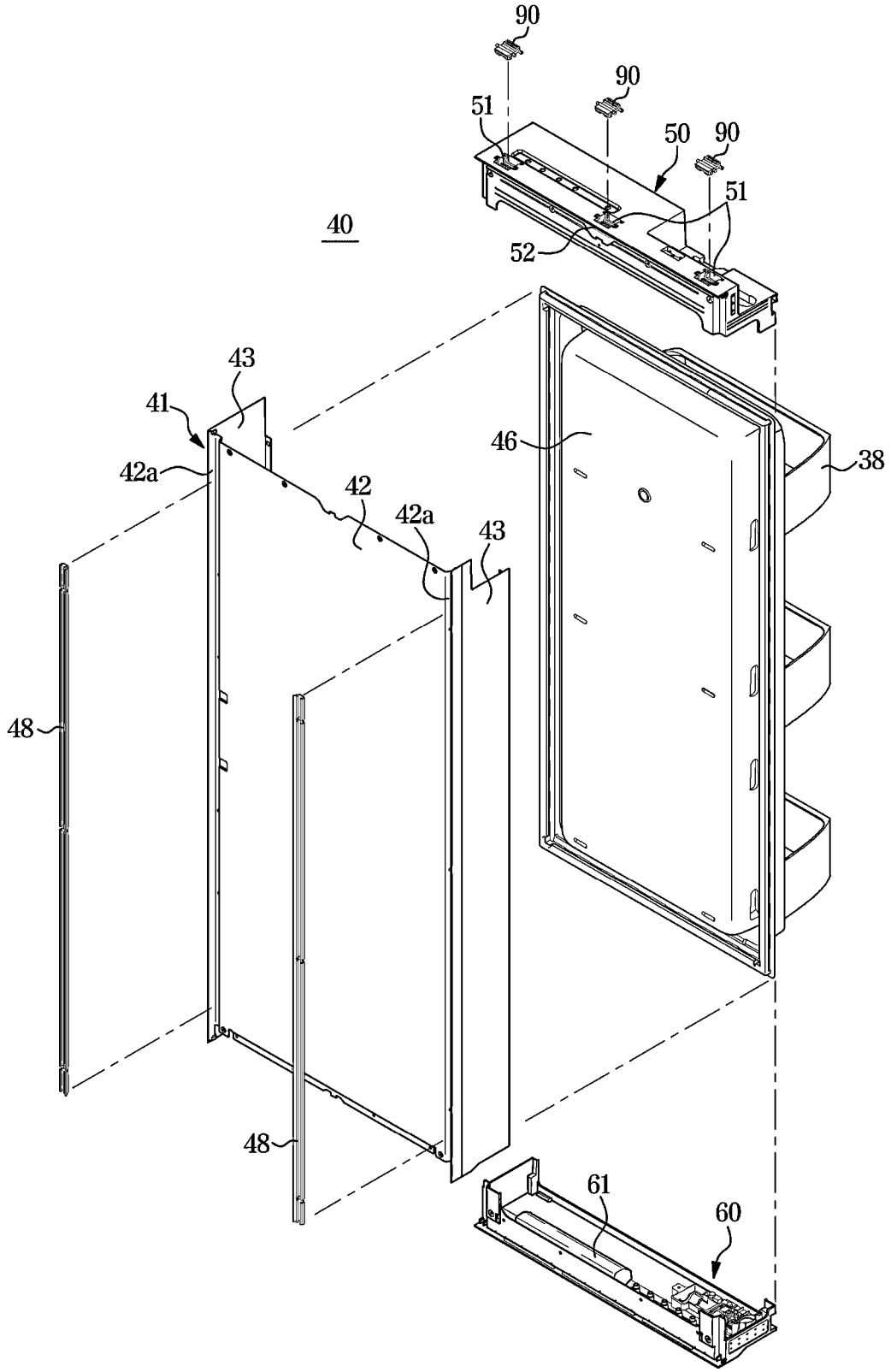
FIG. 4 is an exploded view of the door body according to one embodiment of the present disclosure.

FIG. 2 is a view of a door according to one embodiment of the present disclosure. FIG. 3 is a view illustrating a coupling structure of a door body and a door panel according to one embodiment of the present disclosure. FIG. 4 is an exploded view of the door body according to one embodiment of the present disclosure.

Hereinafter the upper door 32 shown in FIG. 1 will be described. The following description may be equally applied to the other upper door 31. Further, the following description may be equally applied to an upper door of a refrigerator in which a single door is arranged on an upper side and may be equally applied to a door of one-door refrigerator.

The door 32 may include a door body 40 and a door panel 70 configured to be detachably coupled to a front surface of the door body 40. The door panel 70 may be provided to cover an entire front region of the door body 40. That is, the door panel 70 may be formed to have a size corresponding to a size of the front surface of the door body 40. The door panel 70 may be provided in various colors, designs, and materials. A user can select a door panel that suits his/her taste among various door panels, and attach the selected door panel to the door body. After the door panel is attached, the user can remove the door panel and reattach a new door panel.

Figure 8:
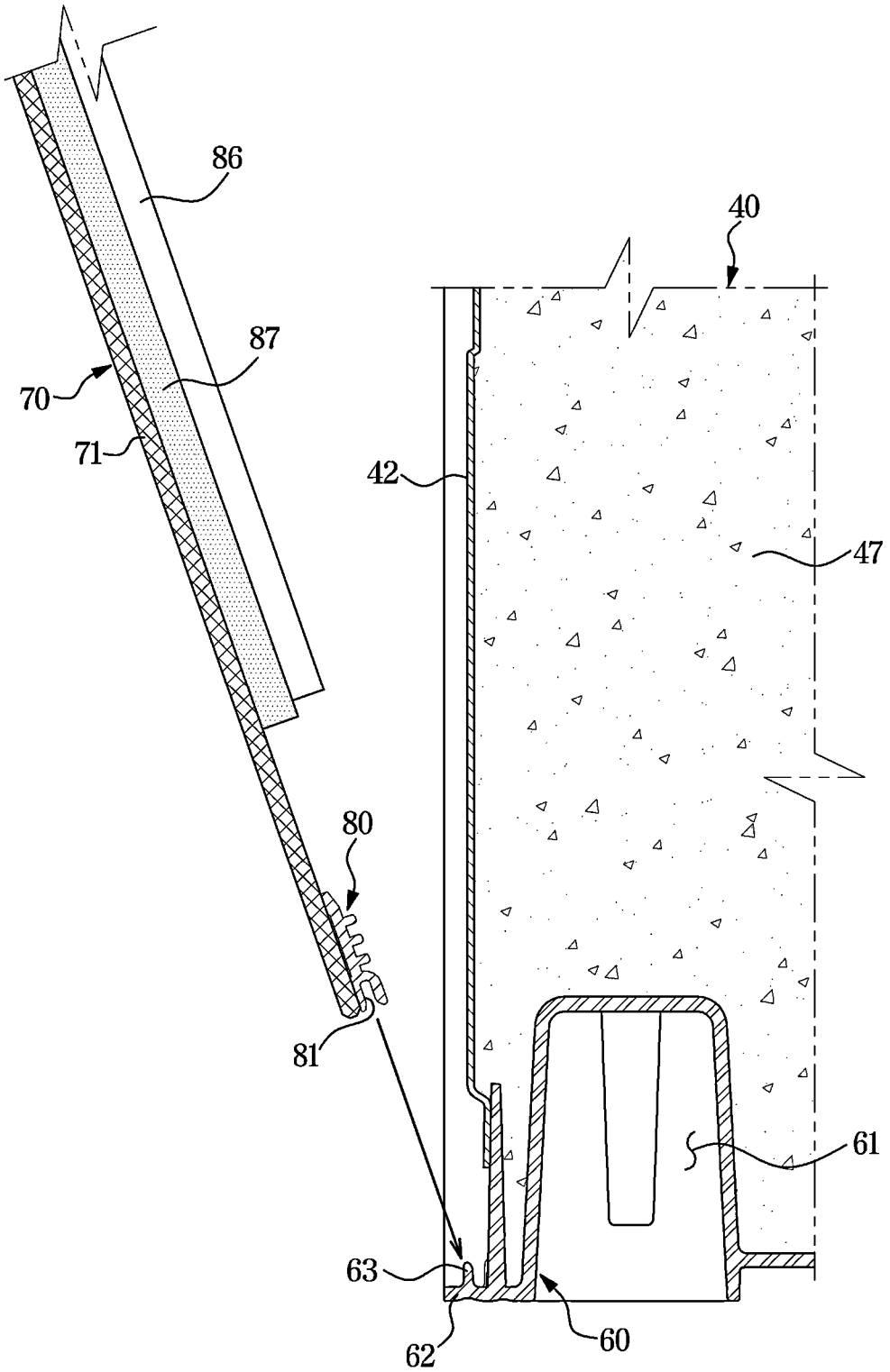
FIG. 8 is a view illustrating an operation of coupling a lower end of the door panel to a lower end of the door body, according to one embodiment of the present disclosure.

The door body 40 may be rotatably coupled to the main body 10 to open and close the storage compartment 21. The door body 40 may include a door outer plate 41, a door inner plate 46, an upper cap 50, a lower cap 60, and a door insulation material 47 (FIG. 8). The door outer plate 41, the door inner plate 46, the upper cap 50, and the lower cap 60 may be coupled to each other to form an inner space of the door. The door insulation material 47 may be arranged in the inner space of the door to insulate the storage compartment 21.

The door outer plate 41 may include a front portion 42 provided to form the front surface of the door body 40, and side portions 43 provided to form both sides of the door body 40. FIG. 4 illustrates that the front portion 42 and the side portions 43 are formed integrally, but is not limited thereto. Alternatively, the front portion 42 and the side portions 43 may be formed separately, and as the front portion 42 and the side portions 43 are coupled to each other, the door outer plate 41 may be formed. Holder mounting grooves 42*a* into which holders 48 for coupling to the door panel 70 are mounted may be formed on left and right ends of the front portion 42. The door inner plate 46 may form a front surface of the storage compartment 21 when the door 32 is closed, and the door gasket 39 and the door shelf 38 may be installed on the door inner plate 46.

The upper cap 50 may be coupled to an upper end of the door outer plate 41. The upper cap 50 may form an upper surface of the door body 40. The upper cap 50 may be injection molded with a resin material.

The lower cap 60 may be coupled to a lower end of the door outer plate 41. The lower cap 60 may form a lower surface of the door body 40. A handle 61 provided to be held by a hand to open and close the door 32 may be recessed in the lower cap 60. The lower cap 60 may be injection molded with a resin material.

The upper cap 50 and the lower cap 60 may be formed with a structure configured to allow the door panel 70 to be detachably coupled to the door body 40. Particularly, an accommodating space 51, a front opening 52, and an upper opening 53 (FIG. 6) may be formed in the upper cap 50, and a lower cap protrusion 63 may be formed in the lower cap 60. This will be described in detail later.

Figure 9:
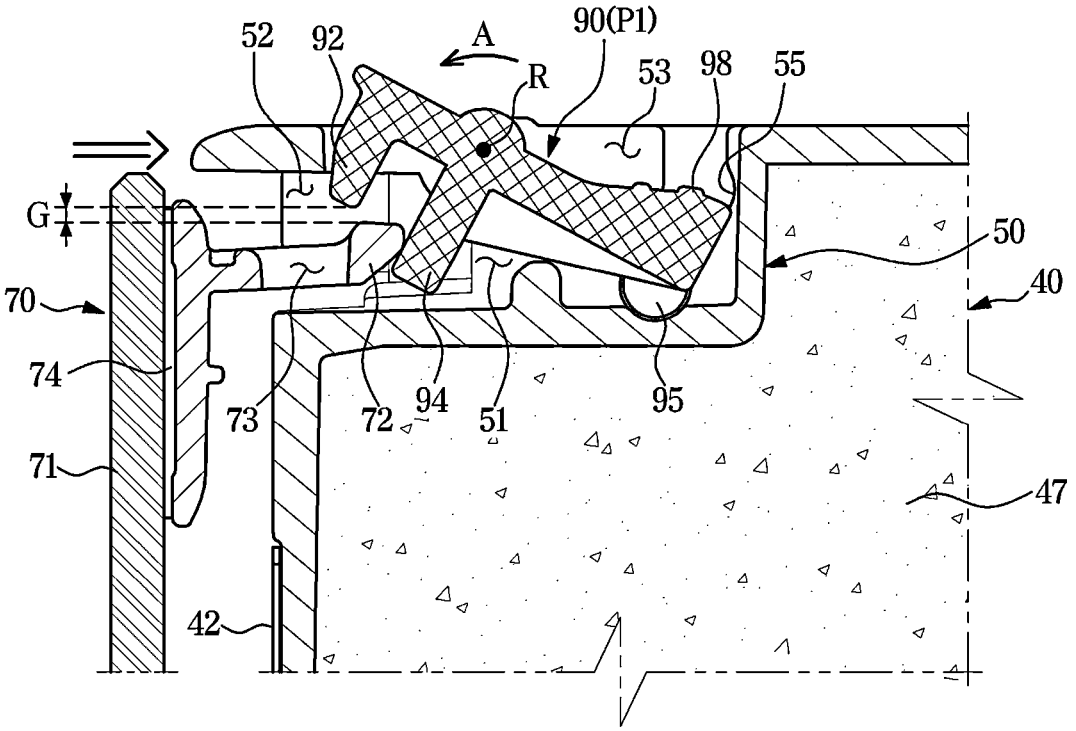
FIG. 9 is a view illustrating an operation in which the fixer rotates from an unlocked position to a locked position when the door panel rotates from a tilted position to an upright position, according to one embodiment of the present disclosure.
Figure 10:
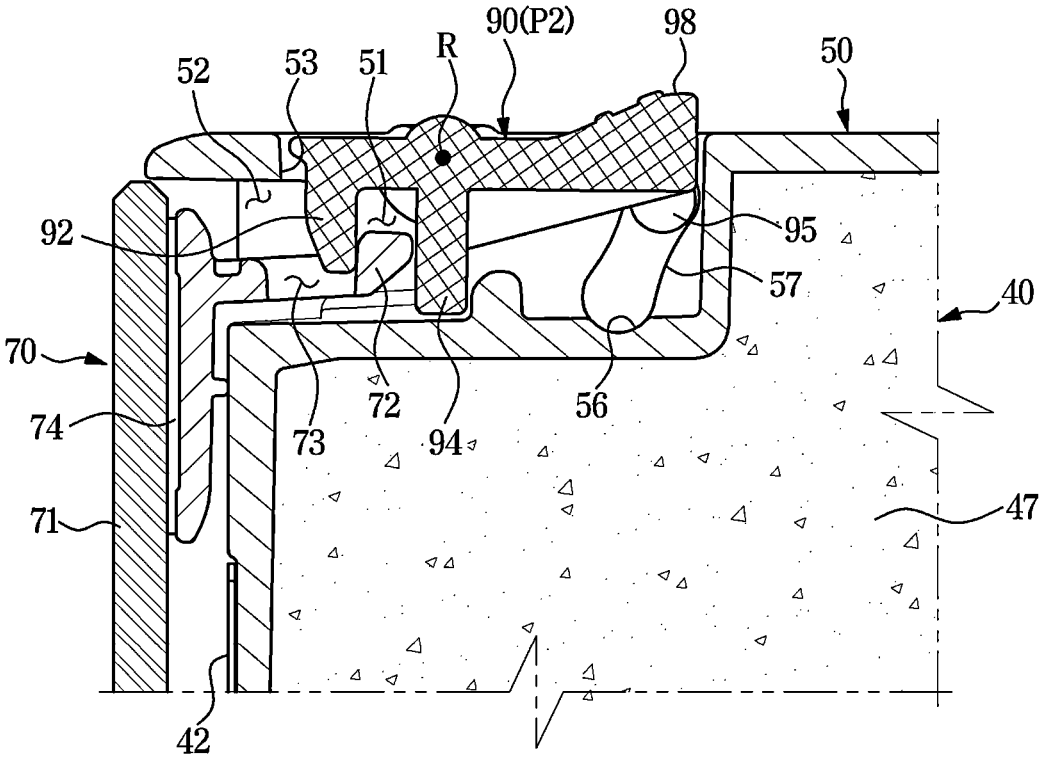
FIG. 10 is a view illustrating a state in which the fixer is coupled to an upper trim, according to one embodiment of the present disclosure, and is a cross-sectional view taken along a line I-I of FIG. 5.

A fixer 90 may be coupled to the upper cap 50. The fixer 90 may rotate between an unlocked position P1 and a locked position P2 in a state in which the fixer 90 is coupled to the upper cap 50 (FIGS. 9 and 10). When the fixer 90 is in the locked position P2, the fixer 90 may be coupled to an upper trim 72 of the door panel 70. When the fixer 90 is in the unlocked position P1, the fixer 90 may be disengaged from the upper trim 72 of the door panel 70. The refrigerator 1 may include at least one fixer 90. The detailed structure of the fixer 90 will be described later.

The door panel 70 may include a panel 71, the upper trim 72, and a lower trim 80. The upper trim 72 may be provided at an upper end of a rear surface of the panel 71. The lower trim 80 may be provided at a lower end of the rear surface of the panel 71. The upper trim 72 may be coupled to the fixer 90 provided on the upper cap 50. The lower trim 80 may be coupled to the lower cap 60.

According to one embodiment, the upper trim 72 and the lower trim 80 may be provided separately from the panel 71 and then coupled to the panel 71 (refer to FIGS. 3 to 23). For example, the upper trim 72 and the lower trim 80 may be coupled to the panel 71 through adhesives 74 and 82. Alternatively, the upper trim 72 and lower trim 80 may be formed integrally with the panel 71 (refer to FIGS. 25 to 32).

The panel 71 may be formed of a glass material or a resin material. When the panel 71 is formed of a glass material or a resin material, the upper trim 72 and the lower trim 80 may be formed separately from the panel 71 and then coupled to the panel 71.

Alternatively, the panel 71 may be formed of a metal material. When the panel 71 is formed of a metal material, the upper trim 72 and the lower trim 80 may be formed integrally with the panel 71. That is, the upper trim 72 may be bent from the upper end of the panel 71, and the lower trim 80 may be bent from the lower end of the panel 71. The specific structures of the upper trim 72 and lower trim 80 will be described later.

The door panel 70 may include side trims 86 provided on left and right ends of the rear surface of the panel 71. The side trims 86 may be formed separately from the panel 71 and coupled to the panel 71. Alternatively, the side trims 86 may be formed integrally with the panel 71. The side trims 86 may be coupled to the holders 48 mounted on the door body 40. By coupling the side trims 86 to the holders 48, the left and right ends of the door panel 70 may be in close contact with the door body 40. According to embodiments, the door panel 70 may include a magnet (not shown). In this case, the front portion 43 of the door body 40 may be formed of a steel plate material to be in close contact with the magnet. The door panel 70 may include a buffer member 87 provided to buffer the friction or impact with the door body 40.

Figure 5:
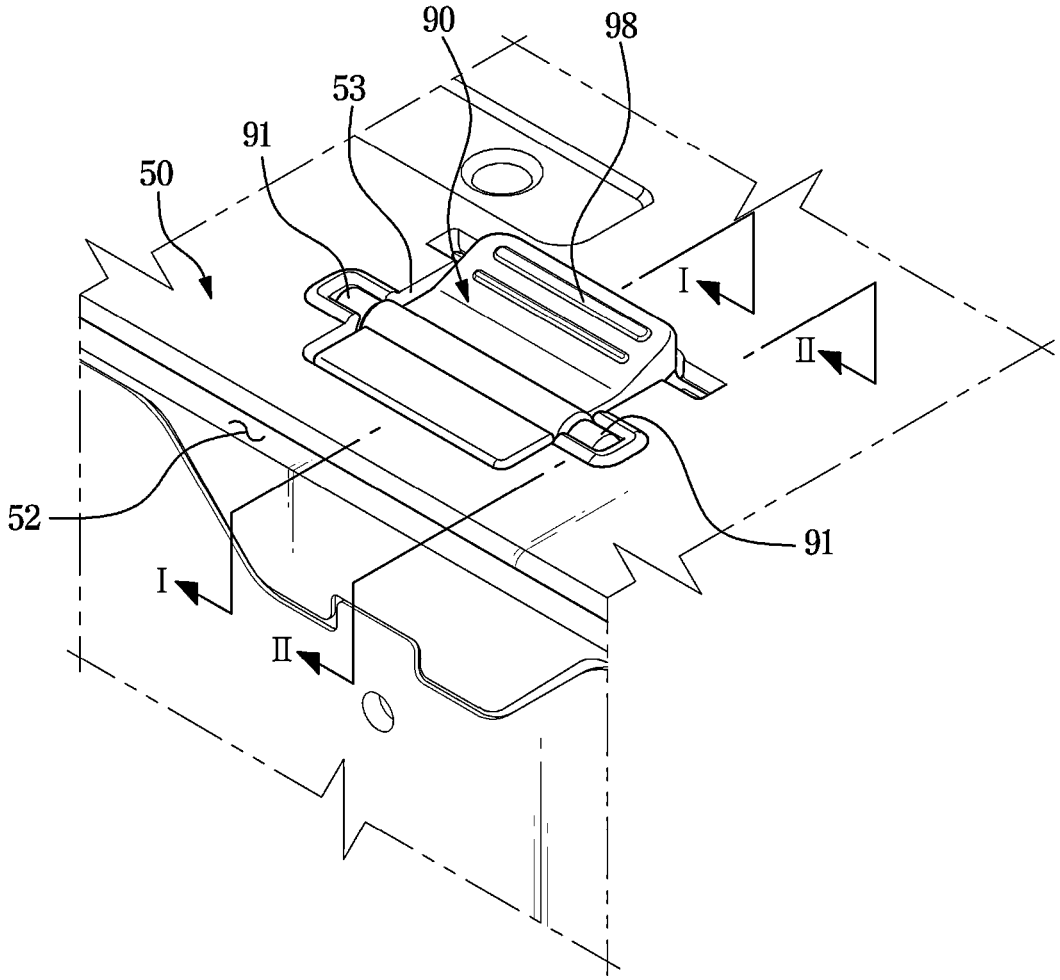
FIG. 5 is a view illustrating a fixer attached to an upper cap according to one embodiment of the present disclosure.
Figure 6:
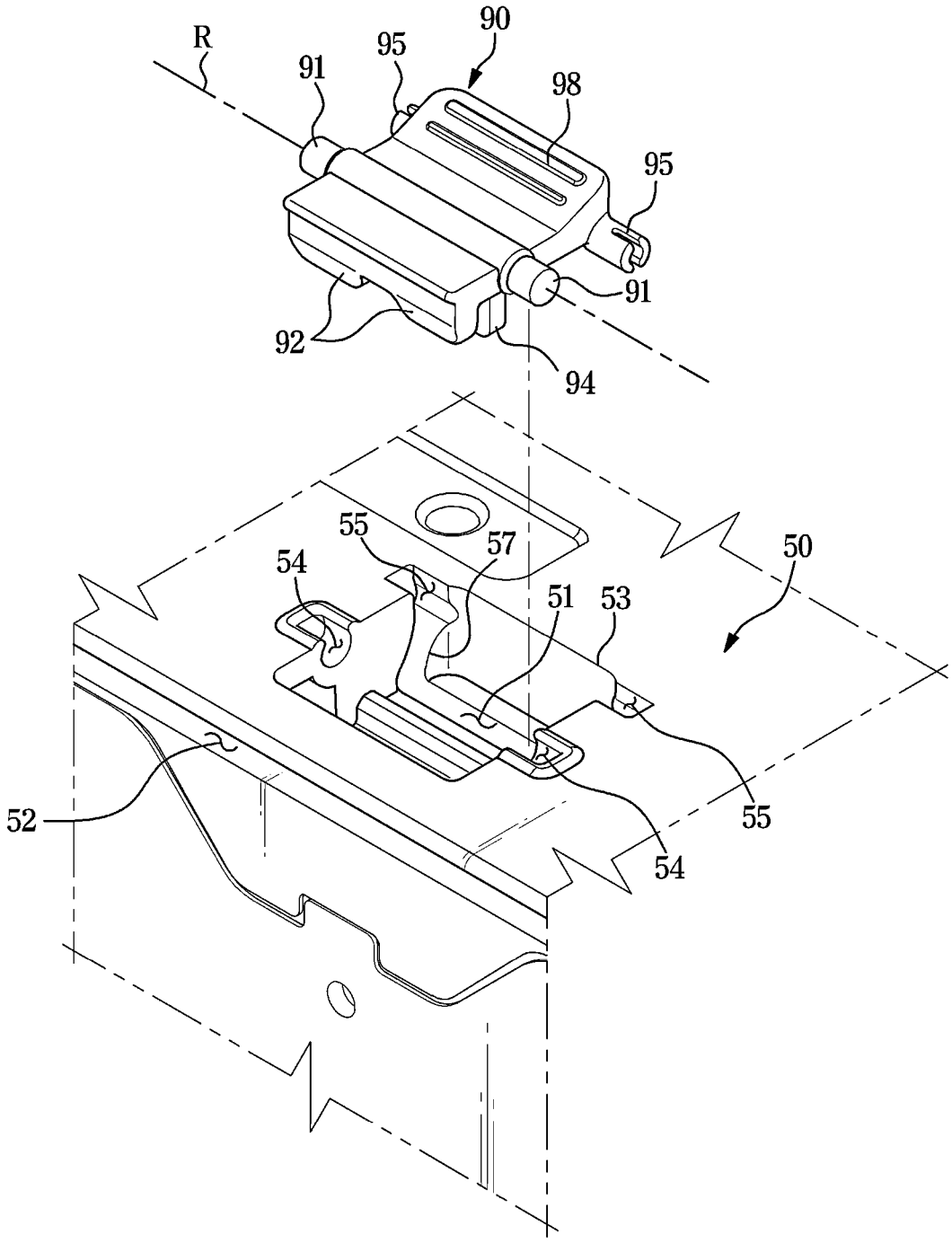
FIG. 6 is a view illustrating a coupling structure of the upper cap and the fixer according to one embodiment of the present disclosure.
Figure 7:
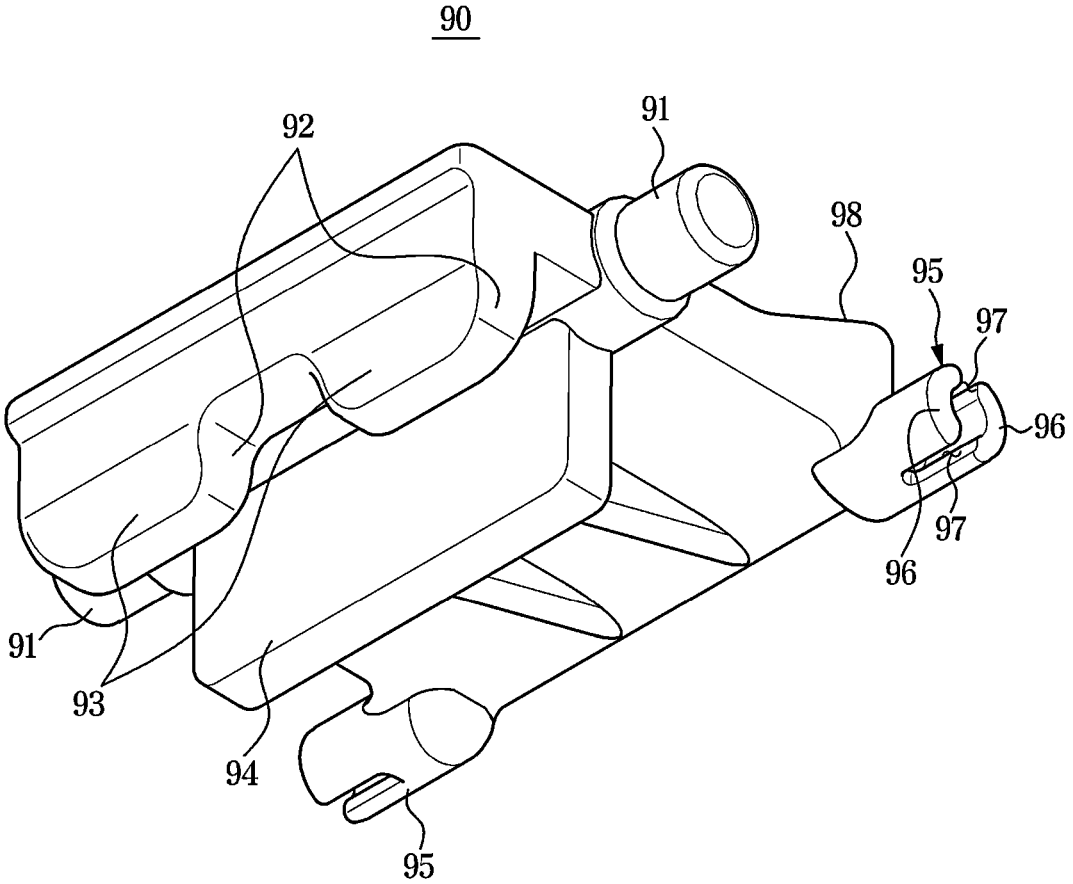
FIG. 7 is a bottom perspective view of the fixer according to one embodiment of the present disclosure.
Figure 11:
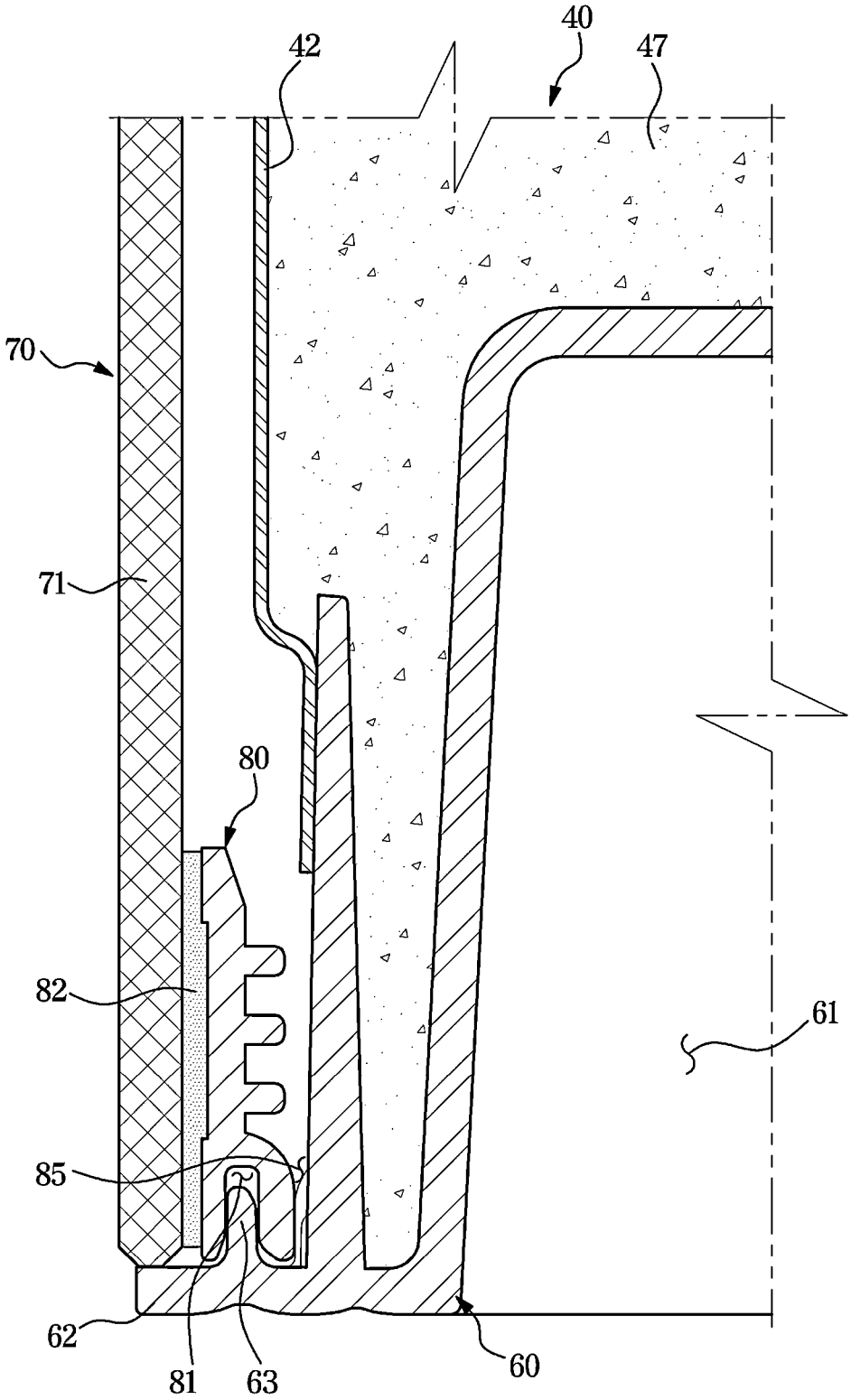
FIG. 11 is a view illustrating a state in which the lower end of the door panel is coupled to the lower end of the door body, according to one embodiment of the present disclosure.

FIG. 5 is a view illustrating a fixer attached to an upper cap according to one embodiment of the present disclosure. FIG. 6 is a view illustrating a coupling structure of the upper cap and the fixer according to one embodiment of the present disclosure. FIG. 7 is a bottom perspective view of the fixer according to one embodiment of the present disclosure. FIG. 8 is a view illustrating an operation of coupling a lower end of the door panel to a lower end of the door body, according to one embodiment of the present disclosure. FIG. 9 is a view illustrating an operation in which the fixer rotates from an unlocked position to a locked position when the door panel rotates from a tilted position to an upright position, according to one embodiment of the present disclosure. FIG. 10 is a view illustrating a state in which the fixer is coupled to an upper trim, according to one embodiment of the present disclosure, and is a cross-sectional view taken along a line I-I of FIG. 5. FIG. 11 is a view illustrating a state in which the lower end of the door panel is coupled to the lower end of the door body, according to one embodiment of the present disclosure.

Referring to FIGS. 5 to 11, the lower cap 60 may include a protruding supporter 62 to support the door panel 70. The supporter 62 may protrude forward from a lower portion of the lower cap 60.

The lower cap 60 may include a lower cap protrusion 63 provided to be coupled to the lower trim 80. The lower cap protrusion 63 may protrude upward from the supporter 62.

The lower trim 80 may include a lower trim hole 81 into which the lower cap protrusion 63 is inserted. The lower trim hole 81 may be formed to be recessed on a lower surface of the lower trim 80. By inserting the lower cap protrusion 63 into the lower trim hole 81, the lower trim 80 may be coupled to the lower cap protrusion 63.

The lower trim 80 may be coupled to the lower cap protrusion 63 to allow the door panel 70 to be tilted with respect to the door body 40 (FIG. 8). The door panel 70 may rotate while the lower trim 80 is coupled to the lower cap protrusion 63. The door panel 70 may rotate about the lower cap protrusion 63. The lower trim 80 may be coupled to the lower cap protrusion 63 to allow the door panel 70 to be parallel to the door body 40 (FIG. 11).

That is, the door panel 70 may rotate between a tilted position in which the lower trim 80 is coupled to the lower cap protrusion 63 and the door panel 70 is tilted with respect to the door body 40, and an upright position in which the lower trim 80 is coupled to the lower cap protrusion 63 and the door panel 70 is upright to be parallel to the door body 40.

The upper cap 50 may include the accommodating space 51 in which the upper trim 72 is accommodated. The front opening 52 may be formed in a front portion of the upper cap 50 to be connected to the accommodating space 51. The upper trim 72 may be accommodated in the accommodating space 51 through the front opening 52. When the door panel 70 rotates from the tilted position to the upright position, the upper trim 72 may be accommodated in the accommodating space 51 through the front opening 52.

The upper opening 53 connected to the accommodating space 51 may be formed in an upper portion of the upper cap 50. The fixer 90 may be coupled to the upper portion of the upper cap 50. Particularly, the fixer 90 may be coupled to the upper portion of the upper cap 50 to cover the upper opening 53. The fixer 90 may be coupled to the upper opening 53.

The fixer 90 may include rotation protrusions 91 provided to form a rotation axis R of the fixer 90. The rotation protrusions 91 may protrude from the left and right sides of the fixer 90. When the fixer 90 is mounted on the upper cap 50, the rotation axis R of the fixer 90 may be formed in the left and right directions of the door body 40 (FIG. 6). The rotation protrusions 91 may be rotatably accommodated in rotation protrusion accommodating holes 54 formed in the upper cap 50. The rotation protrusion 91 may be formed in a substantially cylindrical shape. An upper entrance of the rotation protrusion accommodating hole 54 may be formed to have a diameter relatively less than a diameter of the rotation protrusion 91, and the rotation protrusion 91 may be press-fitted into the rotation protrusion accommodating hole 54. The fixer 90 may be coupled to the upper cap 50 as the rotation protrusions 91 are accommodated in the rotation protrusion accommodating holes 54.

The fixer 90 may include a locking protrusion 92 for coupling with the upper trim 72. The locking protrusion 92 may protrude downward from a front portion of the fixer 90. The locking protrusion 92 may be located in front of the rotation protrusions 91. The upper trim 72 may include an upper trim hole 73 into which the locking protrusion 92 is inserted. The fixer 90 may be coupled to the upper trim 72 by inserting the locking protrusion 92 into the upper trim hole 73. An inclined surface 93 may be formed in a front portion of the locking protrusion 92. A function of the inclined surface 93 will be described later.

The fixer 90 may rotate about the rotation axis R. The fixer 90 may rotate between the unlocked position P1 and the locked position P2. FIG. 9 illustrates an example in which the fixer 90 is in the unlocked position P1. FIG. 10 illustrates an example in which the fixer 90 is in the locked position P2.

When the fixer 90 is in the unlocked position P1, the upper trim 72 may be inserted into or removed from the accommodating space 51 without interfering with the locking protrusion 92 of the fixer 90. For this, when the fixer 90 is in the unlocked position P1, the locking protrusion 92 may be positioned at a height that does not interfere with the upper trim 72. For example, when the upper trim 72 is inserted into the accommodating space 51 in a state in which the fixer 90 is in the unlocked position P1, the locking protrusion 92 and the upper trim 72 may be spaced apart by a predetermined gap G.

When the fixer 90 is in the locked position P2, the upper trim 72 may be positioned at a height that interferes with the locking protrusion 92 of the fixer 90. Accordingly, when the fixer 90 is in the locked position P2, the locking protrusion 92 of the fixer 90 may be inserted into the upper trim hole 73 of the upper trim 72. As mentioned above, the height of the locking protrusion 92 when the fixer 90 is in the unlocked position P1 may be different from the height of the locking protrusion 92 when the fixer 90 is in the locked position P2.

When the door panel 70 rotates from the tilted position to the upright position, the fixer 90 may rotate from the unlocked position P1 to the locked position P2. Accordingly, the locking protrusion 92 of the fixer 90 may be inserted into the upper trim hole 73 of the upper trim 72. The locking protrusion 92 may be inserted into the upper trim hole 73 from top to bottom. The fixer 90 may be coupled to the upper trim 72 by inserting the locking protrusion 92 into the upper trim hole 73. By coupling the fixer 90 to the upper trim 72, the upper end of the door panel 70 may be coupled to the upper end of the door body 40.

Particularly, when the door panel 70 rotates from the tilted position to the upright position, the fixer 90 may be pressed by the upper trim 72, and thus the fixer 90 may rotate from the unlocked position P1 to the locked position P2. That is, the fixer 90 may rotate by the pressure of the upper trim 72. As the upper trim 72 presses a point of the fixer 90 that is spaced apart from the rotation axis R of the fixer 90, the fixer 90 may rotate about the rotation axis R.

The fixer 90 may include an arm 94 configured to be pressed by the upper trim 72. The arm 94 may protrude downward from a portion of the fixer 90. The arm 94 may be formed to extend radially outward from the rotation axis R. With this structure, when the arm 94 is pressed by the upper trim 72, the fixer 90 may rotate smoothly about the rotation axis R.

The arm 94 may be disposed behind the locking protrusion 92. The arm 94 may be pressed by the upper trim 72 when the upper trim 72 enters the accommodating space 51 and, conversely, the arm 94 may press the upper trim 72 when the fixer 90 rotates from the locked position P2 to the unlocked position P1.

The fixer 90 may include a pressing portion 98 provided to be pressed by a user. The pressing portion 98 may be formed on an upper surface of the rear portion of the fixer 90. The pressing portion 98 may be formed behind the rotation axis R. When an external force is applied to the pressing portion 98 from top to bottom, the fixer 90 may rotate. Particularly, when an external force is applied to the pressing portion 98 from top to bottom, the fixer 90 may rotate from the locked position P2 toward the unlocked position P1.

An operation of coupling the door panel 70 to the door body 40 will be briefly described with reference to FIGS. 8 to 11.

First, the fixer 90 may be moved to the unlocked position P1 to allow the upper trim 72 to be inserted into the accommodating space 51. This is because, when the fixer 90 is in the fixed position P2, the upper trim 72 may interfere with the locking protrusion 92 of the fixer 90 and may not be inserted into the accommodating space 51. The fixer 90 may be fixed to the unlocked position P1 by coupling a position fixing protrusion 95, which will be described later, to an unlocking hole 56.

As illustrated in FIG. 8, the lower trim 80 may be coupled to the lower cap protrusion 63 to allow the door panel 70 to be tilted with respect to the door body 40. By inserting the lower cap protrusion 63 into the lower trim hole 81, the lower trim 80 may be coupled to the lower cap protrusion 63.

As illustrated in FIG. 9, the door panel 70 may rotate from the tilted position, in which the lower trim 80 is coupled to the lower cap protrusion 63 and the door panel 70 is tilted with respect to the door body 40, to the upright position in which the lower trim 80 is coupled to the lower cap protrusion 63 and the door panel 70 is upright to be parallel to the door body 40. That is, the door panel 70 may rotate about the lower cap protrusion 63 while the door panel 70 is coupled to the lower cap protrusion 63.

When the door panel 70 rotates from the tilted position to the upright position, the fixer 90 may rotate from the unlocked position P1 to the locked position P2 (direction A of FIG. 9) by being pressed by the upper trim 72. Particularly, when the door panel 70 rotates from the tilted position to the upright position, the arm 94 of the fixer 90 may be pressed by the upper trim 72 and thus the fixer 90 may rotate.

As illustrated in FIG. 10, when the door panel 70 rotates from the tilted position to the upright position, the fixer 90 may rotate from the unlocked position P1 to the locked position P2 and thus the fixer 90 may be coupled to the upper trim 72. The fixer 90 may be coupled to the upper trim 72 by inserting the locking protrusion 92 of the fixer 90 into the upper trim hole 73 of the upper trim 72.

As illustrated in FIG. 11, when the fixer 90 is coupled to the upper trim 72, the lower trim 80 may be coupled to the lower cap protrusion 63 and the door panel 70 may be in the upright position. The door panel 70 may be coupled to the door body 40 as the lower trim 80 is coupled to the lower cap protrusion 63 and the fixer 90 is coupled to the upper trim 72.

As mentioned above, the door panel 70 may be easily coupled to the door body 40 simply by rotating the door panel 70 after coupling the lower trim 80 to the lower cap protrusion 63. In addition, because the fixer 90 is coupled to the door body 40, the fixer 90 may be stored and transported together with the door body 40. Accordingly, it is possible to prevent the loss of the fixer 90 and to easily manage the fixer 90.

Figure 12:
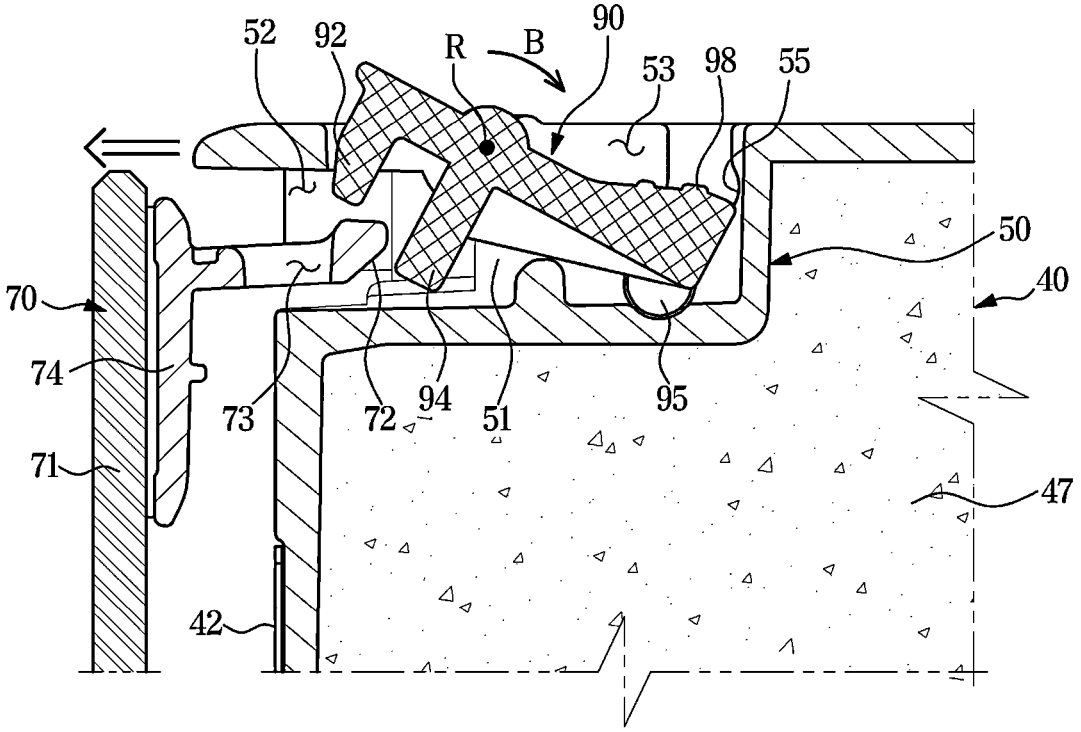
FIG. 12 is a view illustrating an operation in which the door panel rotates from the upright position to the tilted position when the fixer rotates from the locked position to the unlocked position, according to one embodiment of the present disclosure.

An operation of separating the door panel 70 from the door body 40 will be described with reference to FIG. 12.

In a state in which the door panel 70 is coupled to the door body 40, the fixer 90 may be in the locked position P2. When an external force is applied from a user to the pressing portion 98 of the fixer 90, the fixer 90 may rotate from the locked position P2 to the unlocked position P1 about the rotation axis R (direction B of FIG. 12). The arm 94 of the fixer 90 may press the upper trim 72 as the fixer 90 rotates from the locked position P2 to the unlocked position P1. The upper trim 72 may be pressed by the arm 94 and separated from the accommodating space 51. The door panel 70 may rotate from the upright position to the tilted position.

As mentioned above, the upper trim 72 may be separated from the accommodating space 51 simply by pressing the fixer 90, and thus the door panel 70 may rotate from the upright position to the tilted position. Accordingly, the door panel 70 may be easily separated from the door body 40. That is, the door panel 70 may be disassembled from the door body 40 without using a separate tool.

Figure 13:
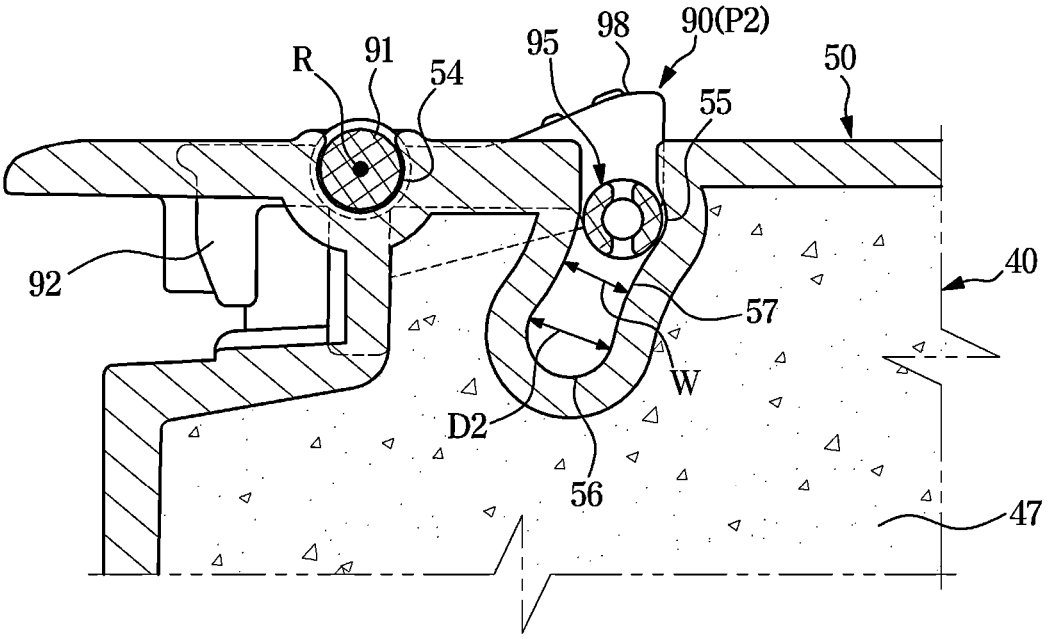
FIG. 13 is a view illustrating a state in which the fixer is fixed to the locked position, according to one embodiment of the present disclosure, and is a cross-sectional view taken along a line II-II of FIG. 5.
Figure 14:
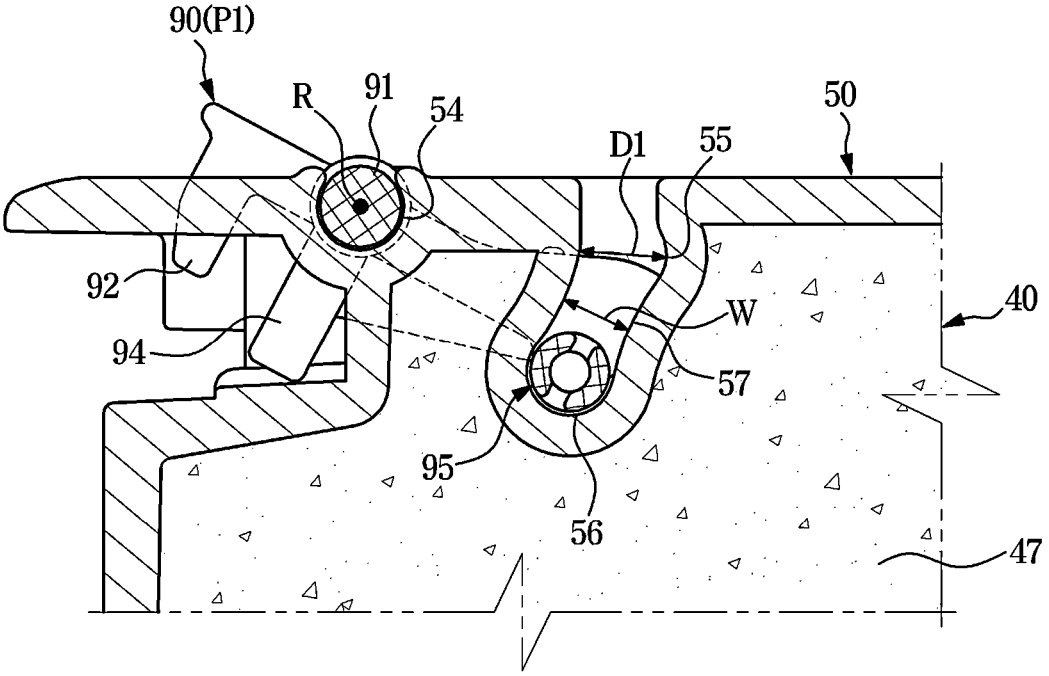
FIG. 14 is a view illustrating a state in which the fixer is fixed to the unlocked position, according to one embodiment of the present disclosure.

FIG. 13 is a view illustrating a state in which the fixer is fixed to the locked position, according to one embodiment of the present disclosure, and is a cross-sectional view taken along a line II-II of FIG. 5. FIG. 14 is a view illustrating a state in which the fixer is fixed to the unlocked position, according to one embodiment of the present disclosure.

A structure for fixing the position of the fixer will be described with reference to FIGS. 7, 13 and 14.

The fixer 90 may include position fixing protrusions 95 provided to fix the position of the fixer 90. The position fixing protrusions 95 may protrude from the left and right portions of the fixer 90. The position fixing protrusion 95 may be formed behind the rotation axis R. That is, the position fixing protrusion 95 may protrude to the left and right from the rear portion of the fixer 90. However, according to embodiments, the fixer 90 may include a single position fixing protrusion provided to protrude from either the left side or the right side of the fixer 90.

The position fixing protrusion 95 may be formed in a substantially cylindrical shape. The position fixing protrusion 95 may be formed to be elastically deformable radially inward with respect to a central axis of the position fixing protrusion 95. For example, the position fixing protrusion 95 may include a plurality of elastic parts 96 formed along a circumferential direction of the central axis of the position fixing protrusion 95 (FIG. 7). The plurality of elastic parts 96 may be formed to be spaced apart from each other. That is, slits 97 may be formed between the plurality of elastic parts 96. Because the position fixing protrusion 95 includes this structure, the position fixing protrusion 95 may be easily elastically deformed.

The upper cap 50 may include a groove defining a locking hole 55 into which the position fixing protrusion 95 is coupled to allow the fixer 90 to be fixed to the locked position P2. The groove of the upper cap 50 may further define the unlocking hole 56 into which the position fixing protrusion 95 is coupled to allow the fixer 90 to be fixed to the unlocked position P1. The groove of the upper cap 50 may include a guide passage 57 configured to guide the movement of the position fixing protrusion 95 between the locking hole 55 and the unlocking hole 56.

When the position fixing protrusion 95 is located in the guide passage 57, the position fixing protrusion 95 may be elastically deformed radially inward. For example, the plurality of elastic parts 96 may be elastically deformed radially inward. When the position fixing protrusion 95 is located in the locking hole 55 or the unlocking hole 56, the position fixing protrusion 95 may be elastically restored. For example, the plurality of elastic parts 96 may be elastically restored. For this, a width W of the guide passage 57 may be less than a width D1 of the locking hole 55 and a width D2 of the unlocking hole 56.

With this structure, the position fixing protrusion 95 may be coupled to the locking hole 55, thereby preventing the door panel 70 from being unintentionally separated from the door body 40. That is, the door panel 70 may be stably maintained in a state of being coupled to the door body 40.

In addition, before coupling the door panel 70 to the door body 40, the position fixing protrusion 95 may be coupled to the unlocking hole 56. Accordingly, it is possible to prevent the interference with the locking protrusion 92 of the fixer 90 in a process in which the upper trim 72 is inserted into the accommodating space 51.

Figure 15:
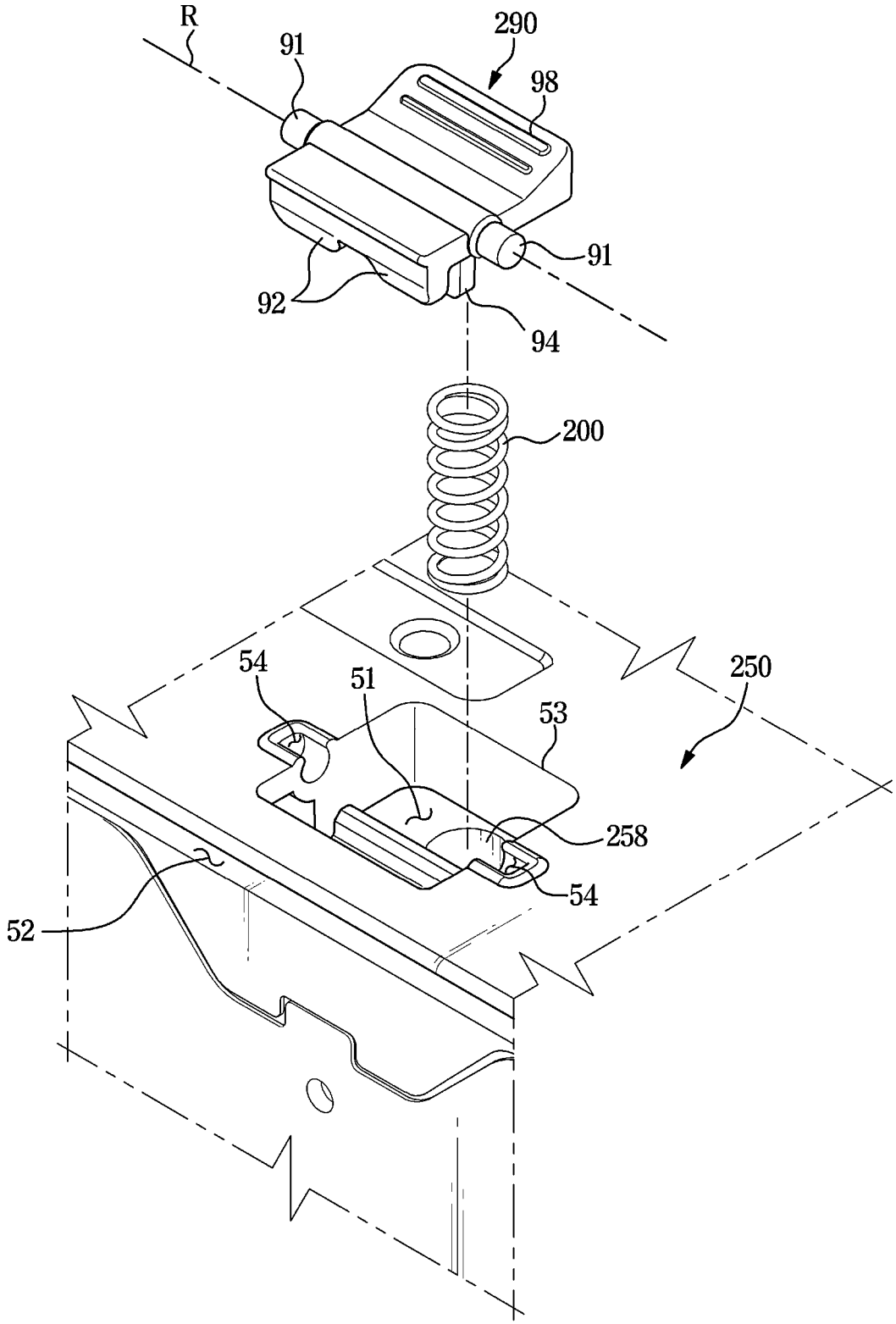
FIG. 15 is a view illustrating an upper cap, an elastic member, and a fixer according to one embodiment of the present disclosure.
Figure 16:
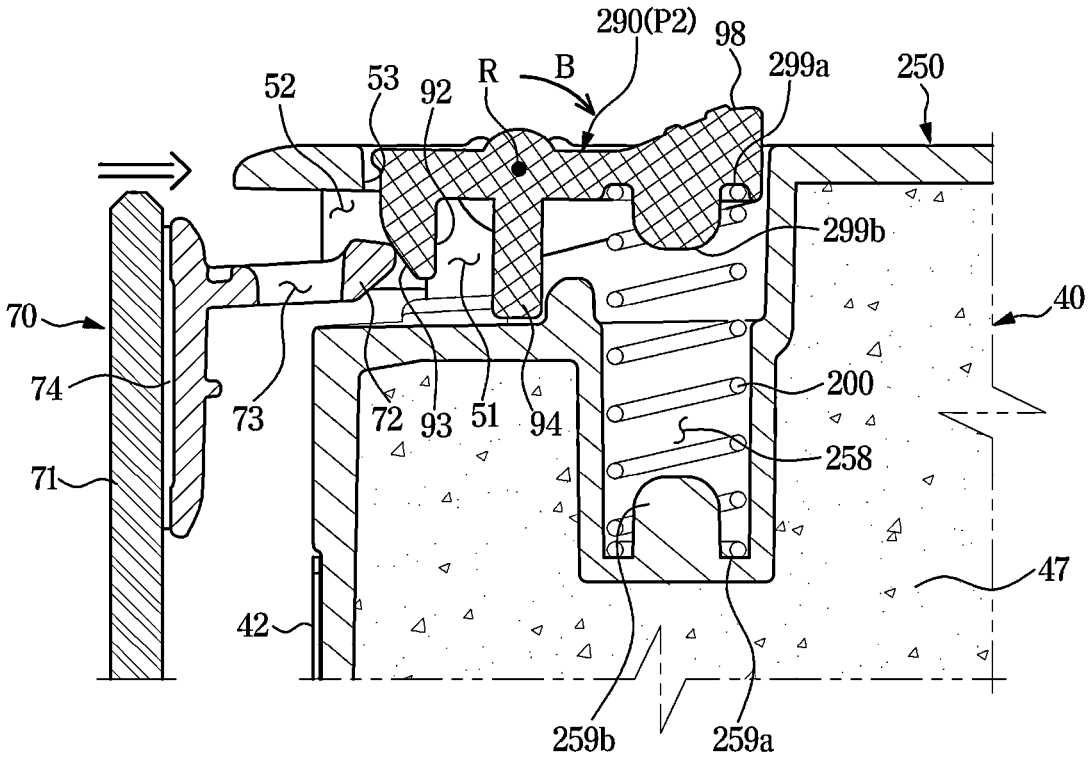
FIG. 16 is a view illustrating a state in which the elastic member starts to deform when the door panel rotates from the tilted position to the upright position, according to one embodiment of the present disclosure.
Figure 17:
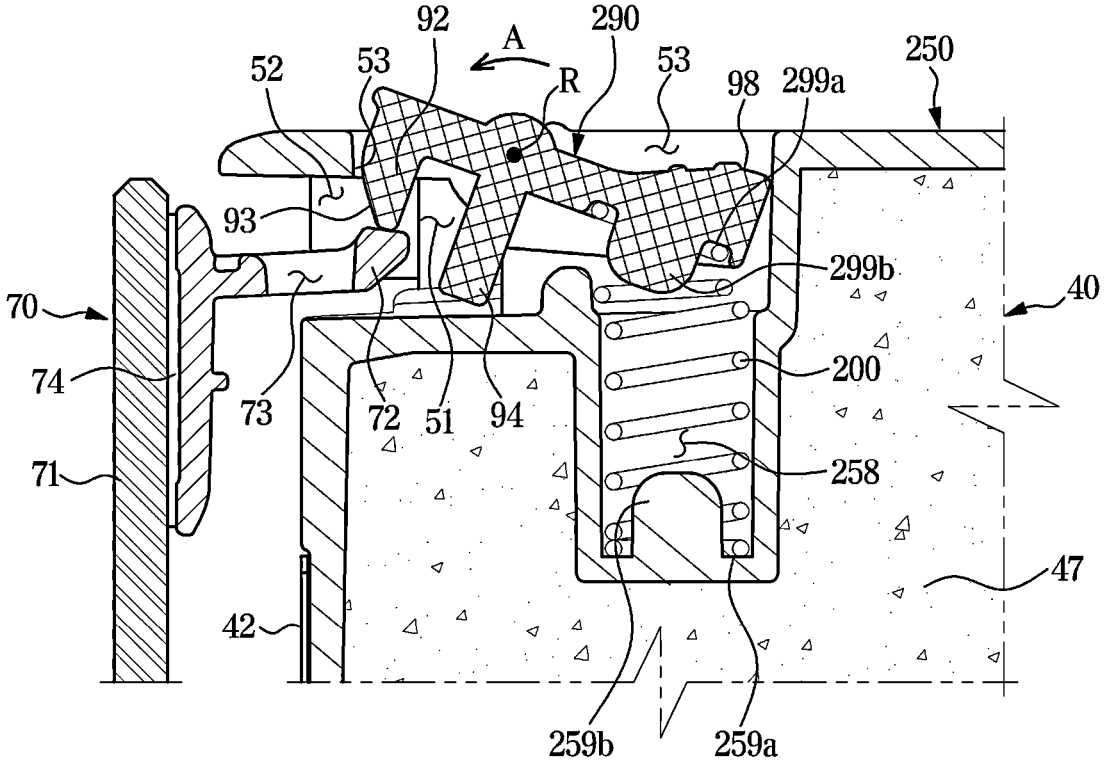
FIG. 17 is a view illustrating a state in which the elastic member is maximally deformed when the door panel rotates from the tilted position to the upright position, according to one embodiment of the present disclosure.
Figure 18:
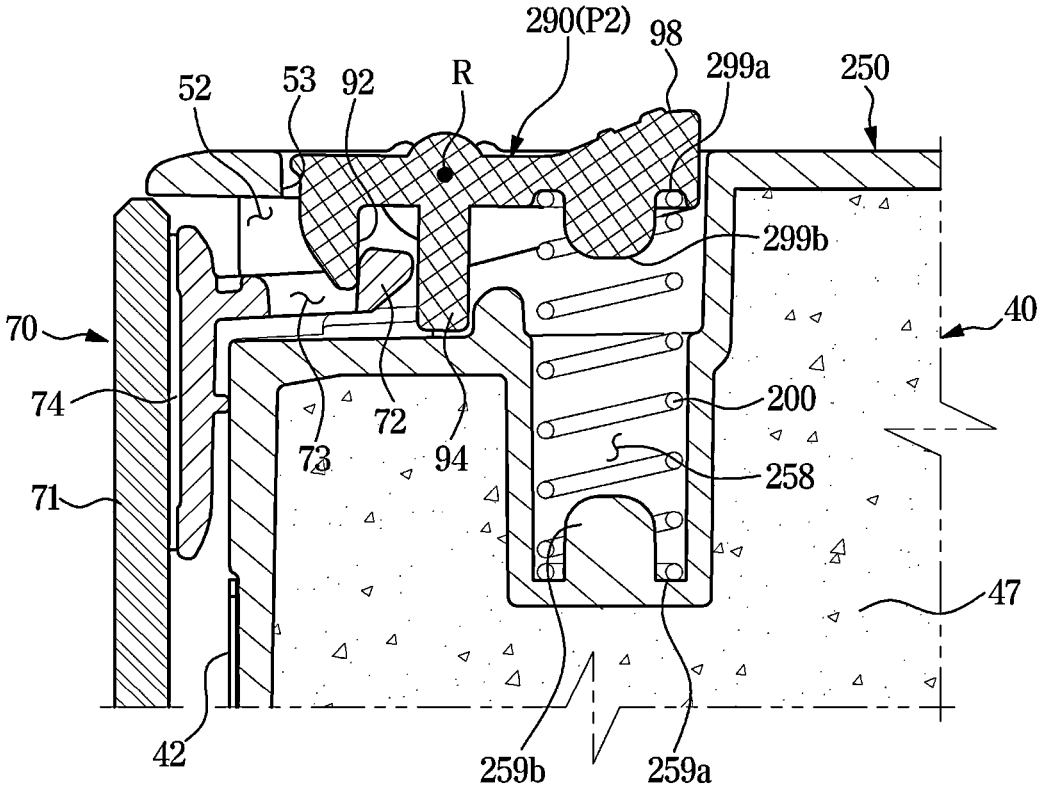
FIG. 18 is a view illustrating a state in which the fixer is coupled to the upper trim, according to one embodiment of the present disclosure.

FIG. 15 is a view illustrating an upper cap, an elastic member, and a fixer according to one embodiment of the present disclosure. FIG. 16 is a view illustrating a state in which the elastic member starts to deform when the door panel rotates from the tilted position to the upright position, according to one embodiment of the present disclosure. FIG. 17 is a view illustrating a state in which the elastic member is maximally deformed when the door panel rotates from the tilted position to the upright position, according to one embodiment of the present disclosure. FIG. 18 is a view illustrating a state in which the fixer is coupled to the upper trim, according to one embodiment of the present disclosure.

Referring to FIGS. 15 to 18, the door body may include an elastic member 200 configured to elastically bias a fixer 290 to the locked position P2. That is, the fixer 290 may be provided on an upper cap 250 to rotate between the unlocked position and the locked position, and the fixer 290 may be elastically biased to the locked position by the elastic member 200 when an external force is not applied. The arm 94 of the fixer 290 may be supported on the upper cap 250 when the fixer 290 is in the locked position. In other words, a rotation angle of the fixer 290 may be limited by the arm 94 of the fixer 290 as the arm 94 is supported by the upper cap 250.

The upper cap 250 may include an elastic member mounting space 258 in which at least a portion of the elastic member 200 is accommodated. The elastic member mounting space 258 may be formed below the accommodating space 51 and connected to the accommodating space 51. The elastic member 200 may be a compression spring.

One end of the elastic member 200 may be supported by an elastic member mount 259*a* of the upper cap 250. The upper cap 250 may include an elastic member holder 259*b* provided to guide the elastic member 200 to allow the elastic member 200 to be stably supported by the elastic member mount 259*a*. The other end of the elastic member 200 may be supported by an elastic member support portion 299*a* of the fixer 290. The fixer 290 may include an elastic member guide 299*b* provided to guide the elastic member 200 to allow the elastic member 200 to be stably supported by the elastic member support portion 299*a*.

When an external force is applied to the fixer 290 through the pressing portion 98, the fixer 290 may rotate toward the unlocked position. As the fixer 290 rotates from the locked position to the unlocked position, the fixer 290 may press the elastic member 200. As the elastic member 200 is compressed by the pressure of the fixer 290, an elastic force may be accumulated in the elastic member 200.

As illustrated in FIG. 18, when the external force acting on the fixer 290 is removed, the elastic member 200 may be restored and the elastic force accumulated in the elastic member 20 may act on the fixer 290, causing the fixer 290 to rotate to the locked position P2.

Further, as shown in FIGS. 16 and 17, the fixer 290 may rotate from the locked position to the unlocked position by the inclined surface 93 formed on the locking protrusion 92. That is, when the door panel 70 rotates from the tilted position to the upright position, the inclined surface 93 may be pressed by the upper trim 72, and the locking protrusion 92 may move upward, causing the fixer 290 to rotate to the locked position from the unlocked position. As the fixer 290 rotates from the locked position to the unlocked position, the fixer 290 may press the elastic member 200. As the elastic member 200 is pressed by the pressure of the fixer 290, the elastic force may be accumulated in the elastic member 200.

As illustrated in FIG. 18, when the external force acting on the fixer 290 is removed, the elastic member 200 may be restored and the elastic force accumulated in the elastic member 20 may act on the fixer 290, causing the fixer 290 to rotate to the locked position P2. That is, when the door panel 70 rotates from the tilted position to the upright position, the fixer 290 may rotate from the unlocked position to the locked position by the elastic force of the elastic member 200, and thus the fixer 290 may be coupled to the upper trim 72.

Figure 19:
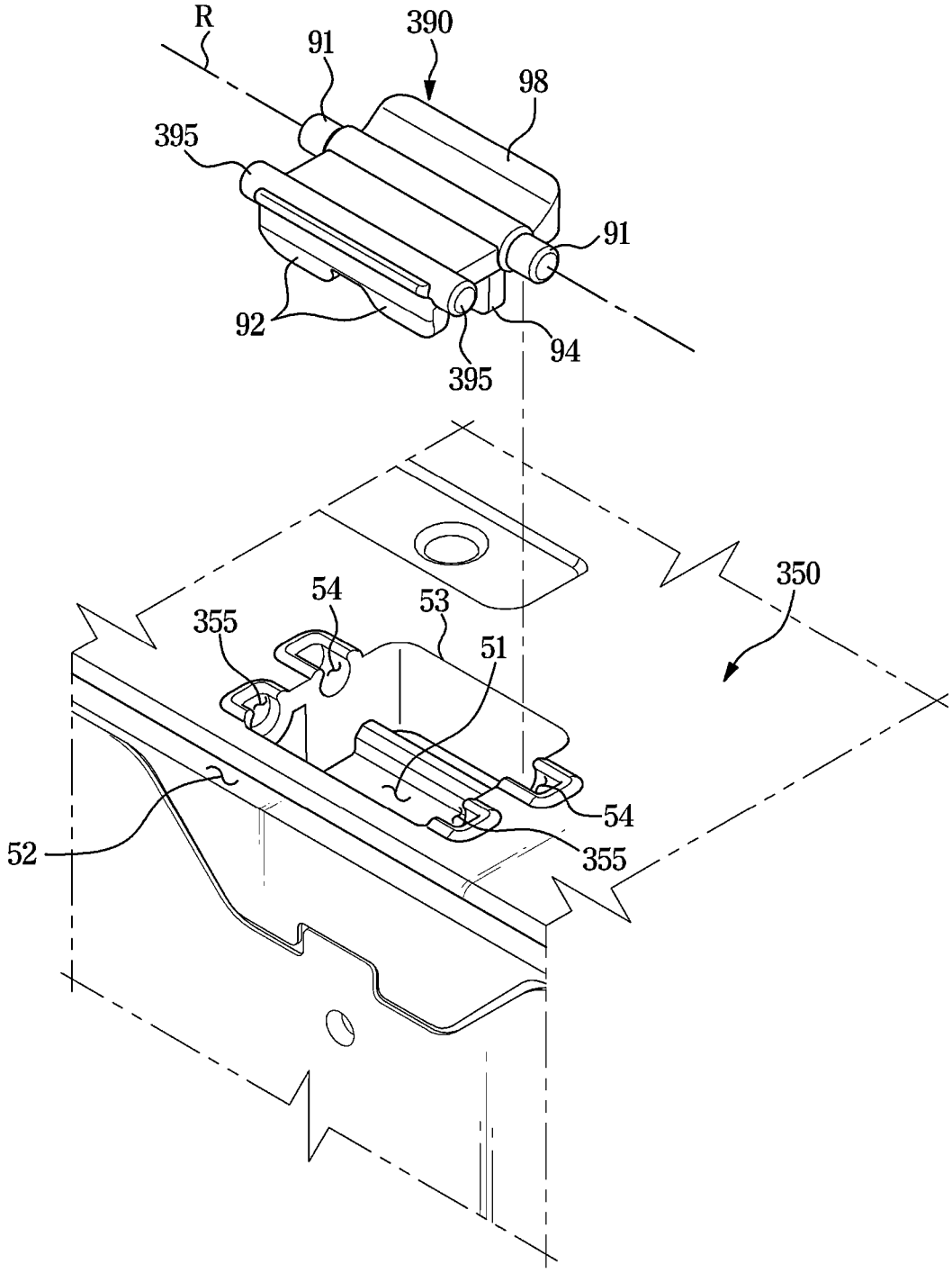
FIG. 19 is a view illustrating a coupling structure of an upper cap and a fixer according to one embodiment of the present disclosure.
Figure 20:
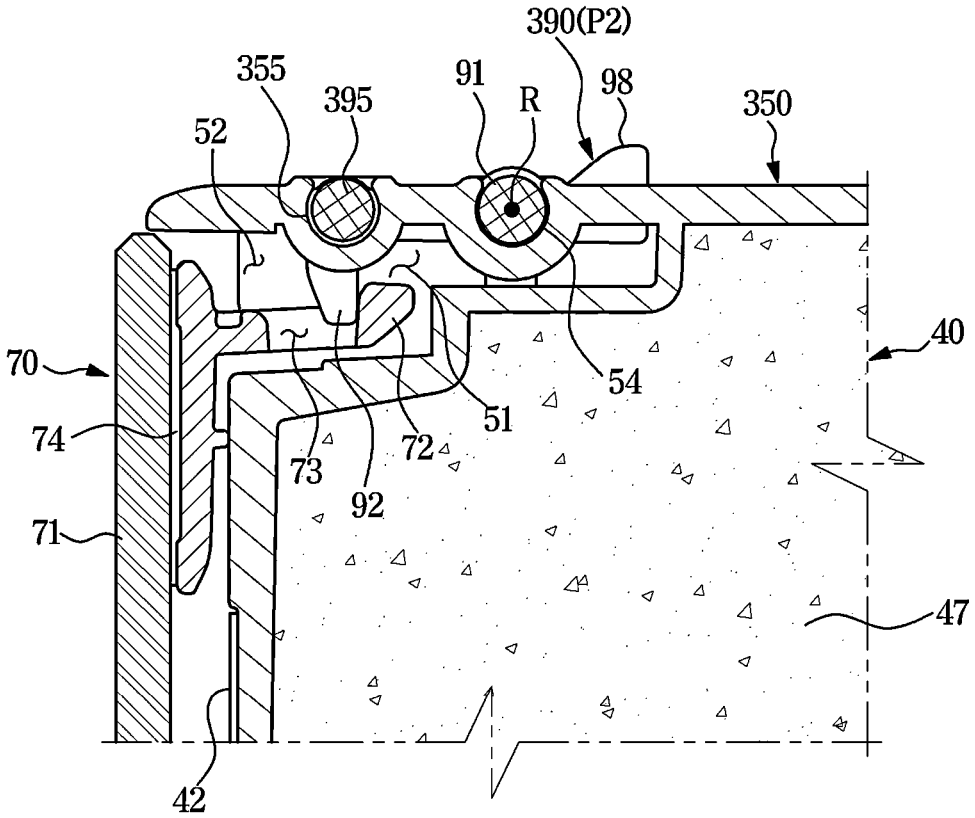
FIG. 20 is a view illustrating a state in which the fixer is coupled to an upper trim, according to one embodiment of the present disclosure.

FIG. 19 is a view illustrating a coupling structure of an upper cap and a fixer according to one embodiment of the present disclosure. FIG. 20 is a view illustrating a state in which the fixer is coupled to an upper trim, according to one embodiment of the present disclosure.

Referring to FIGS. 19 and 20, a fixer 390 may include position fixing protrusions 395 provided to fix a position of the fixer 390. The position fixing protrusions 395 may protrude from left and right sides of the fixer 390. The position fixing protrusion 395 may be formed in front of the rotation axis R. That is, the position fixing protrusion 395 may protrude to the left and right from a front portion of the fixer 390. However, according to embodiments, the fixer 390 may include a single position fixing protrusion provided to protrude from either the left side or the right side of the fixer 390.

The upper cap 350 may include a locking hole 355 into which the position fixing protrusion 395 is coupled to allow the fixer 390 to be fixed to the locked position P2. The locking hole 355 may be formed in front of the rotation protrusion accommodating hole 54 in which the rotation protrusion 91 is accommodated. An upper entrance of the locking hole 355 may be formed to have a diameter relatively less than a diameter of the position fixing protrusion 395, and the position fixing protrusion 395 may be press-fitted into the locking hole 355.

Figure 21:
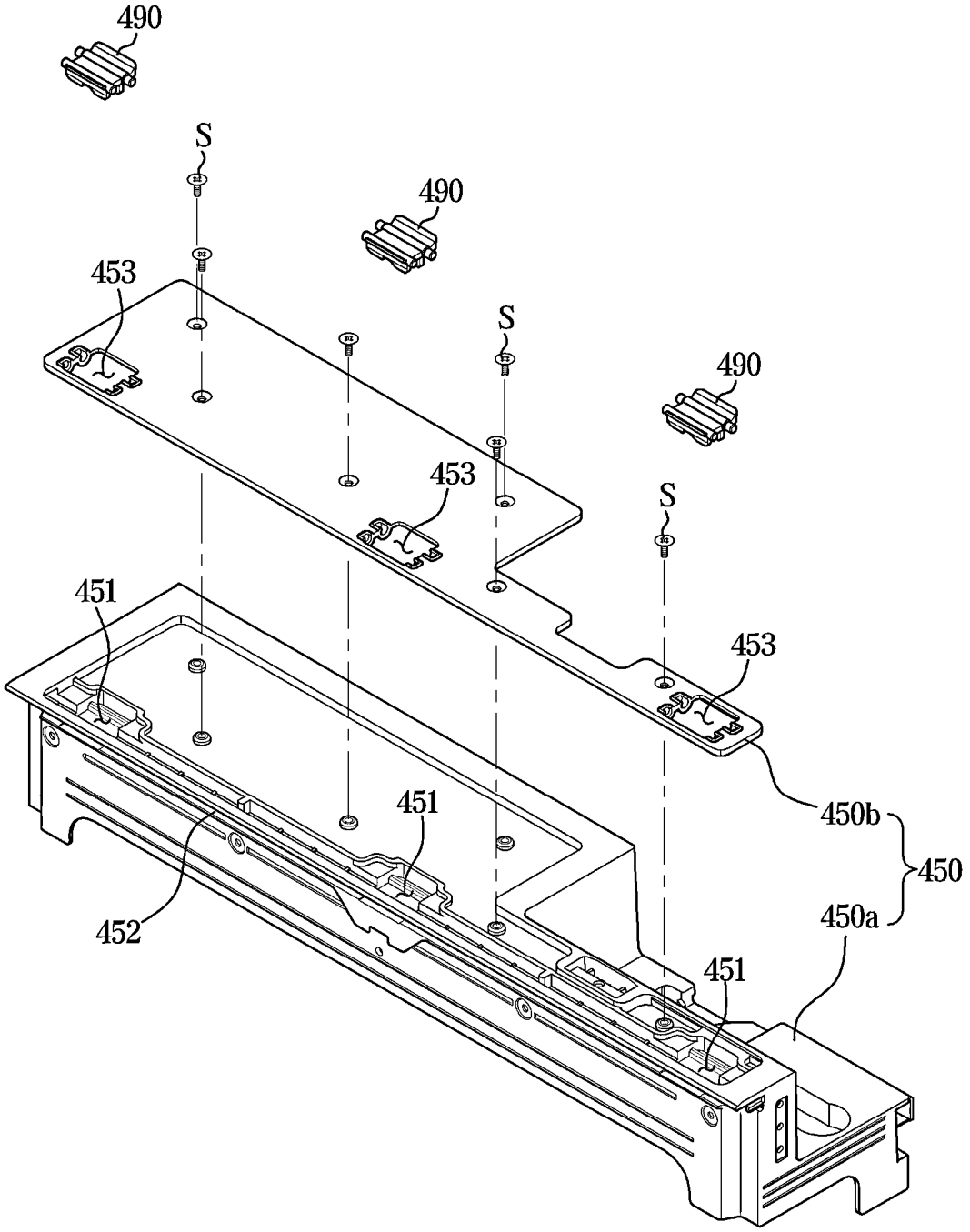
FIG. 21 is a view illustrating a coupling structure of an upper cap and a fixer according to one embodiment of the present disclosure.
Figure 22:
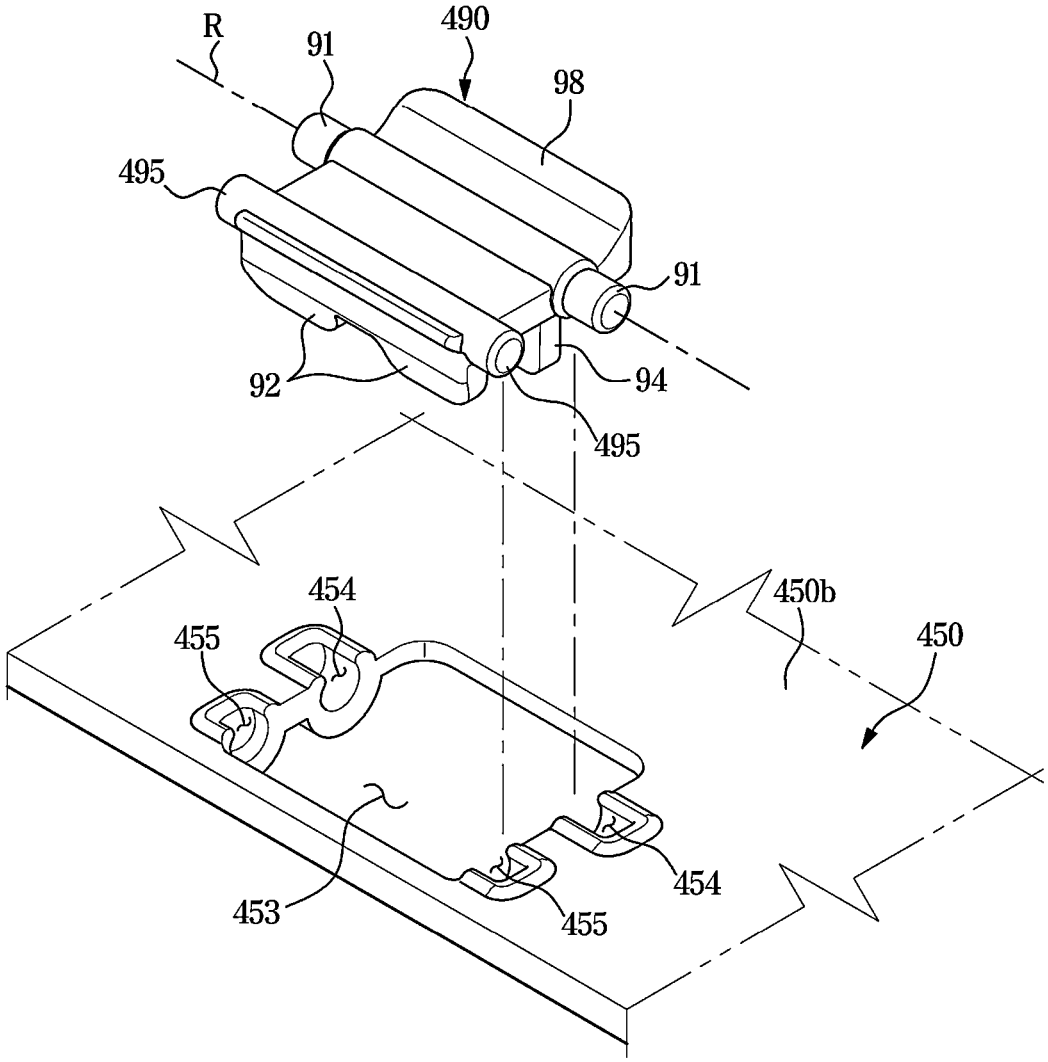
FIG. 22 is a view illustrating a cap cover and the fixer according to one embodiment of the present disclosure.
Figure 23:
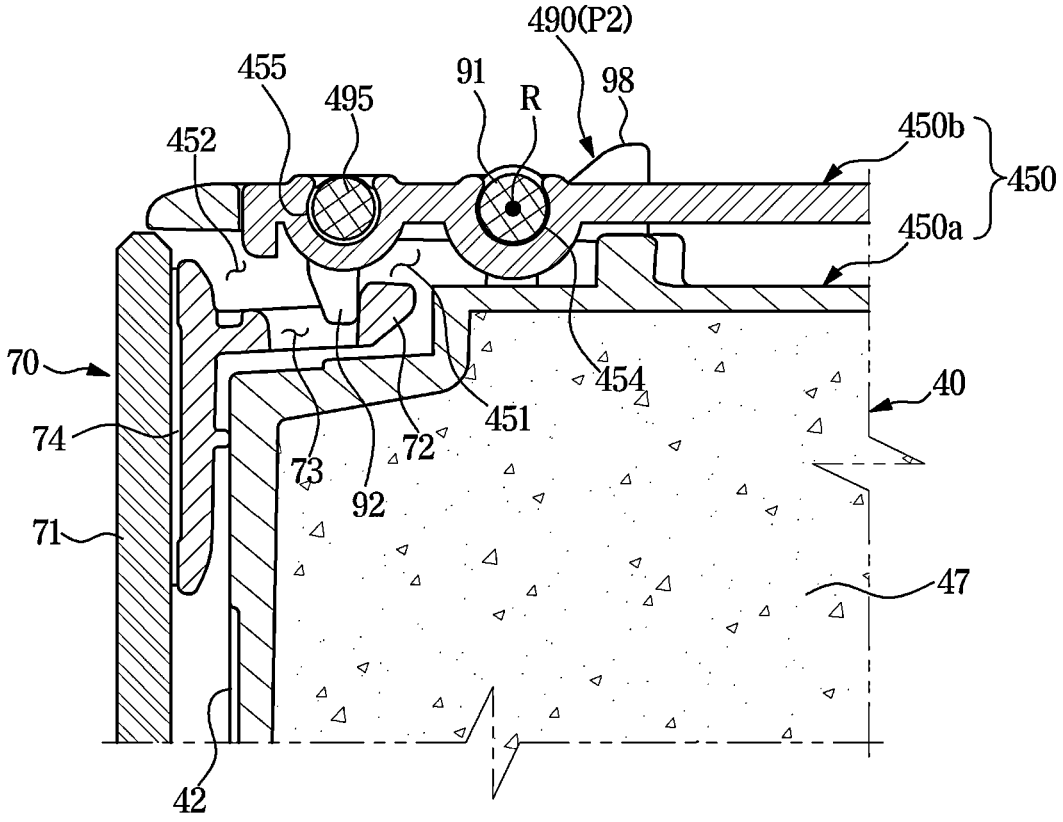
FIG. 23 is a view illustrating a state in which the fixer is coupled to an upper trim, according to one embodiment of the present disclosure.

FIG. 21 is a view illustrating a coupling structure of an upper cap and a fixer according to one embodiment of the present disclosure. FIG. 22 is a view illustrating a cap cover and the fixer according to one embodiment of the present disclosure. FIG. 23 is a view illustrating a state in which the fixer is coupled to an upper trim, according to one embodiment of the present disclosure.

Referring to FIGS. 21 to 23, an upper cap 450 may include an upper cap body 450*a* including an accommodating space 451 and a cap cover 450*b* coupled to an upper end of the upper cap body 450*a*. The cap cover 450*b* may be coupled to an upper end of the upper cap body 450*a* through a fastening member S such as a screw. The cap cover 450*b* may cover at least a portion of the accommodating space 451.

A front opening 452 connected to the accommodating space 451 may be formed in a front portion of the upper cap body 450*b*. The upper trim 72 may be accommodated in the accommodating space 451 through the front opening 452.

An upper opening 453 connected to the accommodating space 451 may be formed in the cap cover 450*b*. The fixer 490 may be coupled to the cap cover 450*b*. The fixer 490 may be coupled to the cap cover 450*b* to cover the upper opening 453. The fixer 490 may be coupled to the upper opening 453. A rotation protrusion accommodating hole 454 in which the rotation protrusion 91 is rotatably accommodated may be formed in the cap cover 450*b*.

The fixer 490 may include position fixing protrusions 495 provided to fix a position of the fixer 490. The position fixing protrusions 495 may protrude from left and right sides of the fixer 490. The position fixing protrusion 495 may be formed in front of the rotation axis R. That is, the position fixing protrusions 495 may protrude to the left and right from the front portion of the fixer 490. However, according to embodiments, the fixer 490 may include a single position fixing protrusion provided to protrude from either the left side or the right side of the fixer 490.

The cap cover 450*b* may include a locking hole 455 into which the position fixing protrusion 495 is coupled to allow the fixer 490 to be fixed to the locked position P2.

Figure 24:
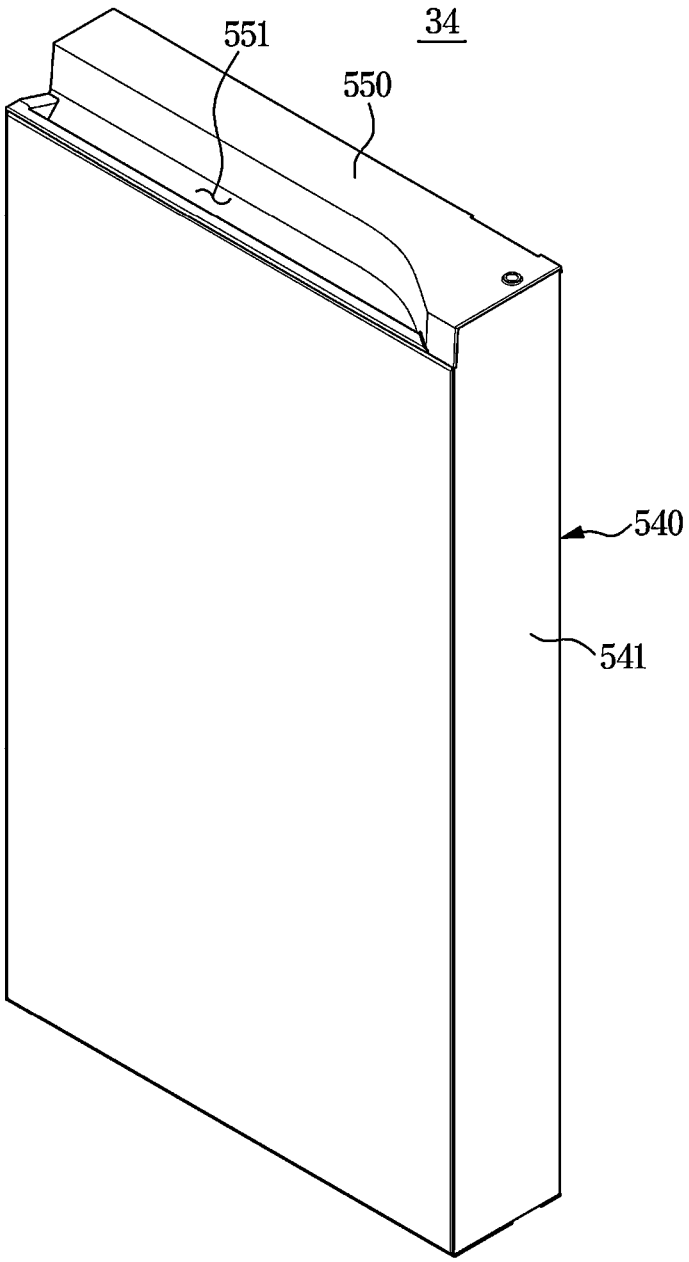
FIG. 24 is a view illustrating a door according to one embodiment of the present disclosure.
Figure 25:
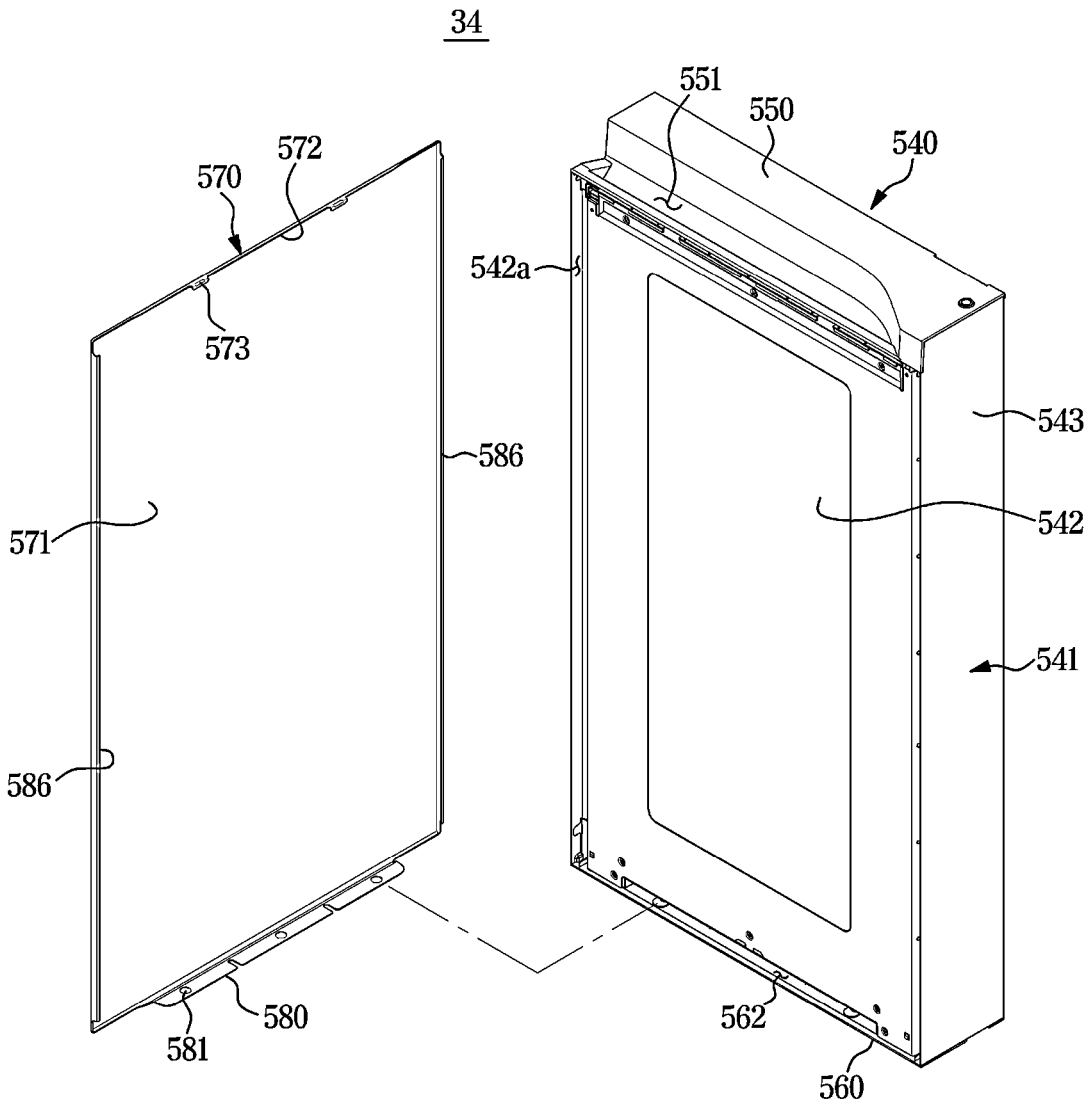
FIG. 25 is a view illustrating a coupling structure of a door body and a door panel according to one embodiment of the present disclosure.
Figure 26:
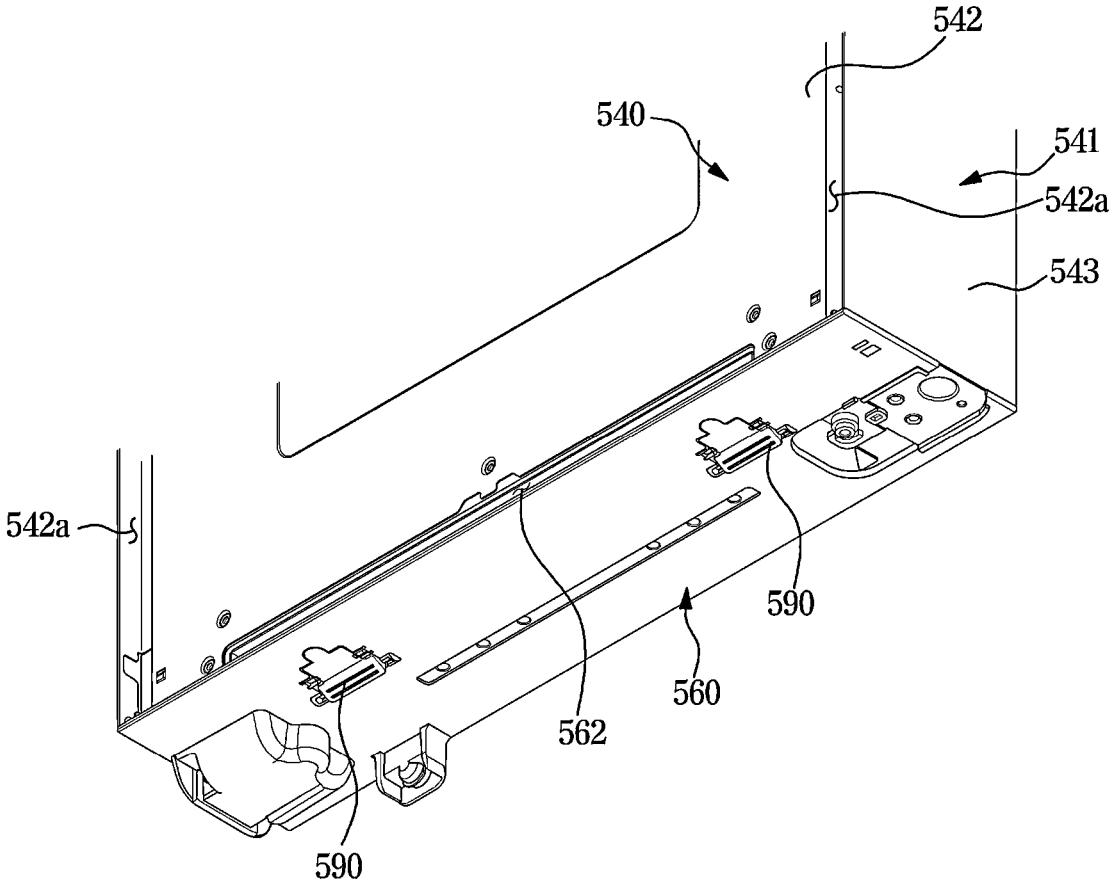
FIG. 26 is a bottom view of the door body according to one embodiment of the present disclosure.
Figure 27:
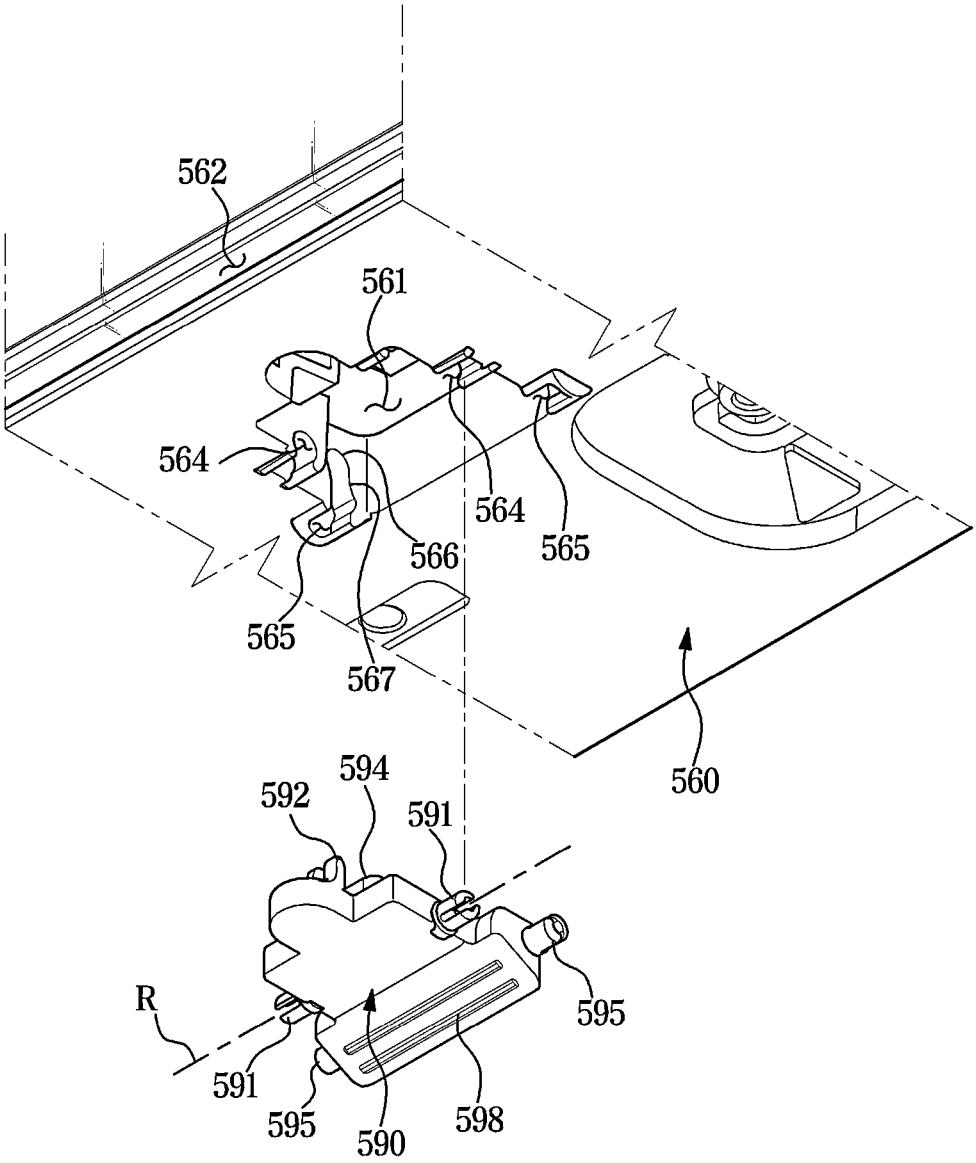
FIG. 27 is a view illustrating a coupling structure of a lower cap and a fixer according to one embodiment of the present disclosure.
Figure 28:
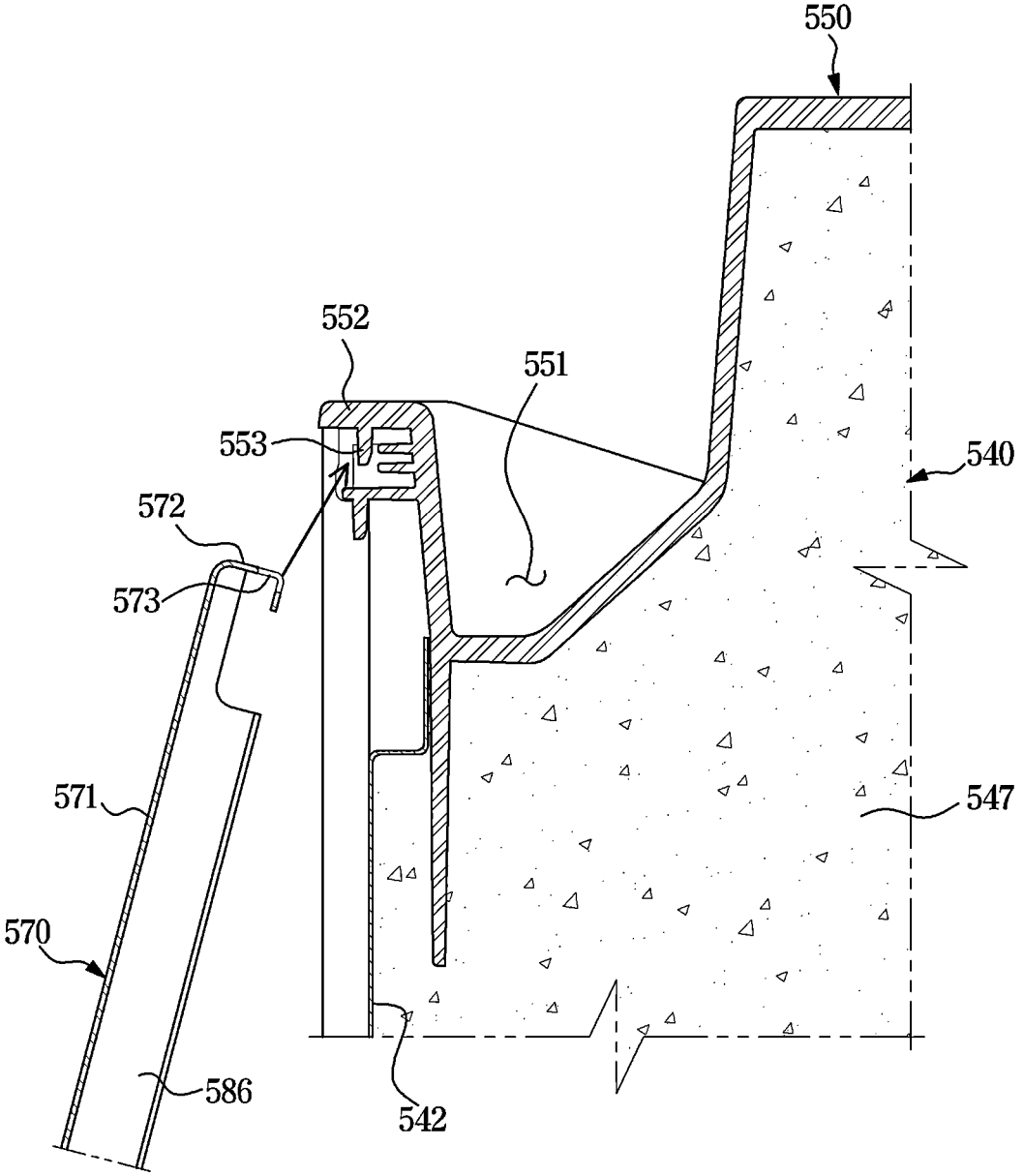
FIG. 28 is a view illustrating an operation of coupling an upper end of the door panel to an upper end of the door body, according to one embodiment of the present disclosure.
Figure 29:
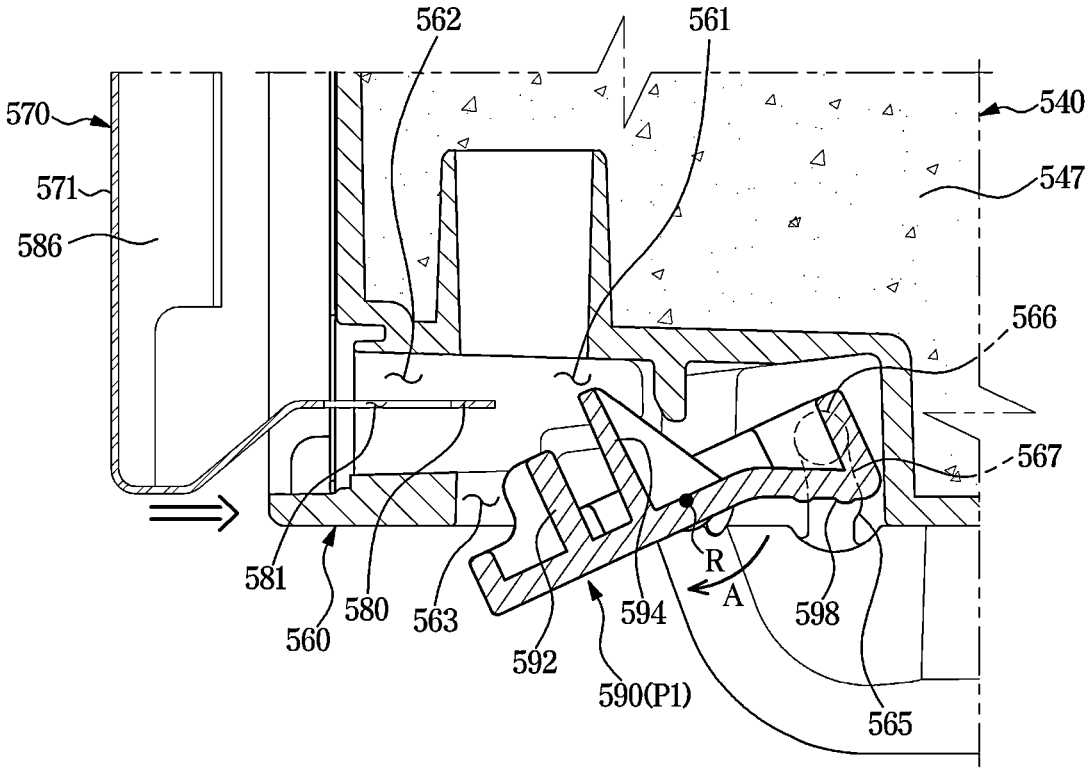
FIG. 29 is a view illustrating an operation in which the fixer rotates from an unlocked position to a locked position when the door panel rotates from a tilted position to an upright position, according to one embodiment of the present disclosure.
Figure 30:
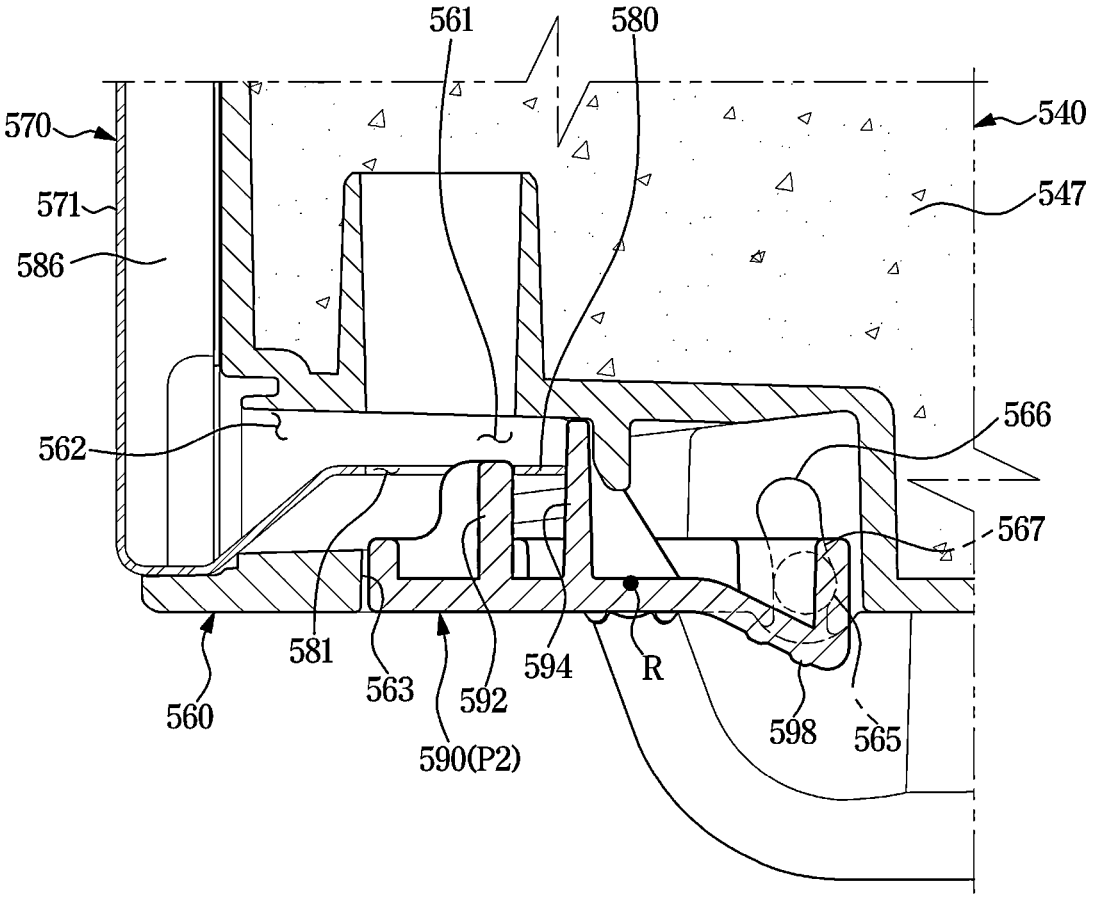
FIG. 30 is a view illustrating a state in which the fixer is coupled to a lower trim, according to one embodiment of the present disclosure.
Figure 31:
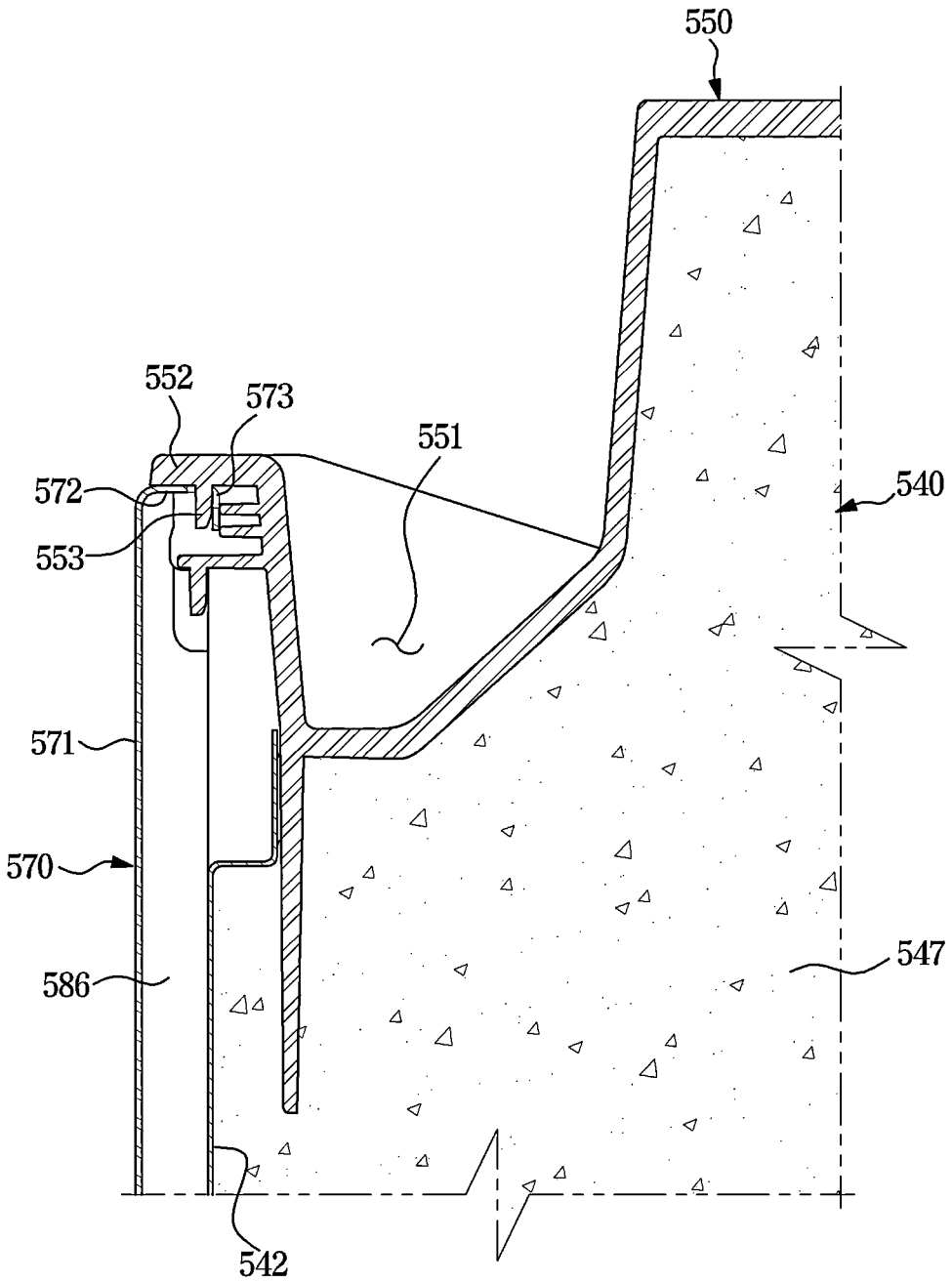
FIG. 31 is a view illustrating a state in which the upper end of the door panel is coupled to the upper end of the door body, according to one embodiment of the present disclosure.
Figure 32:
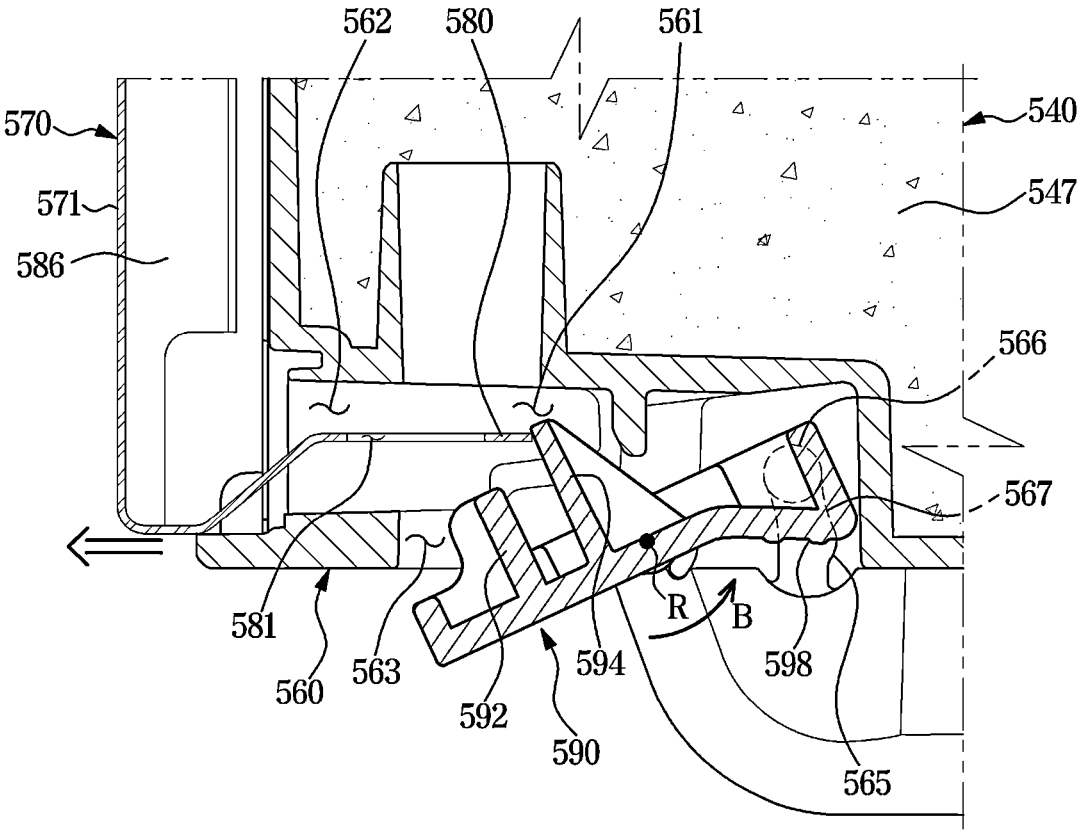
FIG. 32 is a view illustrating an operation in which the door panel rotates from the upright position to the tilted position when the fixer rotates from the locked position to the unlocked position, according to one embodiment of the present disclosure.

FIG. 24 is a view illustrating a door according to one embodiment of the present disclosure. FIG. 25 is a view illustrating a coupling structure of a door body and a door panel according to one embodiment of the present disclosure. FIG. 26 is a bottom view of the door body according to one embodiment of the present disclosure. FIG. 27 is a view illustrating a coupling structure of a lower cap and a fixer according to one embodiment of the present disclosure. FIG. 28 is a view illustrating an operation of coupling an upper end of the door panel to an upper end of the door body, according to one embodiment of the present disclosure. FIG. 29 is a view illustrating an operation in which the fixer rotates from an unlocked position to a locked position when the door panel rotates from a tilted position to an upright position, according to one embodiment of the present disclosure. FIG. 30 is a view illustrating a state in which the fixer is coupled to a lower trim, according to one embodiment of the present disclosure. FIG. 31 is a view illustrating a state in which the upper end of the door panel is coupled to the upper end of the door body, according to one embodiment of the present disclosure. FIG. 32 is a view illustrating an operation in which the door panel rotates from the upright position to the tilted position when the fixer rotates from the locked position to the unlocked position, according to one embodiment of the present disclosure.

Hereinafter the lower door 34 shown in FIG. 1 will be described. The following description may be equally applied to other lower doors 33 shown in FIG. 1, and may also be applied equally to a lower door of a refrigerator provided with only one lower door.

The door 34 may include a door body 540 and a door panel 570 configured to be detachably coupled to a front surface of the door body 540.

The door body 540 may be rotatably coupled to the main body 10 to open and close the storage compartment 23. The door body 540 may include a door outer plate 541, a door inner plate, an upper cap 550, a lower cap 560, and a door insulation material 547.

The door outer plate 541 may include a front portion 542 provided to form the front surface of the door body 540 and side portions 543 provided to form both sides of the door body 540. FIG. 25 illustrates an example in which the front portion 542 and the side portions 543 are formed integrally with each other. Alternatively, the front portion 542 and the side portions 543 may be formed separately and the door outer plate 541 may be formed by coupling the front portion 542 to the side portions 543. Holder mounting grooves 542*a*, in which holders (not shown) for coupling to the door panel 570 are mounted, may be formed on left and right ends of the front portion 542.

The upper cap 550 may be coupled to an upper end of the door outer plate 541. The upper cap 550 may form an upper surface of the door body 540. A handle 551 provided to be held by a hand to open and close the door 34 may be recessed in the upper cap 550.

The lower cap 560 may be coupled to a lower end of the door outer plate 541. The lower cap 560 may form a lower surface of the door body 540. The lower cap 560 may be injection molded with a resin material.

A structure configured to allow the door panel 570 to be detachably coupled to the door body 540 may be formed on the upper cap 550 and the lower cap 560. Particularly, an upper cap protrusion 553 may be formed in the upper cap 550, and an accommodating space 561, a front opening 562, and a lower opening 563 may be formed in the lower cap 560. The specific details of this structure will be described later.

A fixer 590 may be coupled to the lower cap 560. The fixer 590 may rotate between the unlocked position P1 and the locked position P2 while the fixer 590 is coupled to the lower cap 560. When the fixer 590 is in the locked position P2, the fixer 590 may be coupled to the lower trim 580 of the door panel 570. When the fixer 590 is in the unlocked position P1, the fixer 590 may be disengaged from the lower trim 580 of the door panel 570.

The door panel 570 may include a panel 571, an upper trim 572, and a lower trim 580. The upper trim 572 may be provided at an upper end of a rear surface of the panel 571. The lower trim 580 may be provided at a lower end of the rear surface of the panel 571. The upper trim 572 may be coupled to the upper cap 550. The lower trim 580 may be coupled to the fixer 590 provided on the lower cap 560.

According to one embodiment, the upper trim 572 and the lower trim 580 may be formed integrally with the panel 571. The panel 571 may be formed of a metal material. The upper trim 572 and the lower trim 580 may be formed integrally with the panel 571. That is, the upper trim 572 may be bent from an upper end of the panel 571, and the lower trim 580 may be bent from a lower end of the panel 571.

Alternatively, the upper trim 572 and lower trim 580 may be formed separately from the panel 571 and coupled to the panel 571. At this time, the panel 571 may be formed of a glass material or a resin material. The upper trim 572 and lower trim 580 may be coupled to the panel 71 through an adhesive.

The door panel 570 may include side trims 586 provided on left and right ends of the rear surface of the panel 571. The side trims 586 may be formed integrally with the panel 571. Alternatively, the side trims 586 may be formed separately from the panel 571 and coupled to the panel 571. The side trims 586 may be coupled to holders mounted on the door body 540. By coupling the side trims 586 to the holders, the left and right ends of the door panel 570 may be in close contact with the door body 540. According to embodiments, the door panel 570 may include a magnet (not shown). In this case, the front portion 542 of the door body 540 may be formed of a steel plate material to be in close contact with the magnet.

The upper cap 550 may include a cover portion 552 provided to protrude to cover the upper end of the door panel 570. The cover portion 552 may protrude forward from the upper portion of the upper cap 550.

The upper cap 550 may include an upper cap protrusion 553 provided to be coupled to the upper trim 572. The upper cap protrusion 553 may protrude downward from the cover portion 552.

The upper trim 572 may include an upper trim hole 573 into which the upper cap protrusion 553 is inserted. The upper trim hole 573 may have a form of a through hole penetrating the upper trim 572. Alternatively, the upper trim hole 573 may be formed in the shape of a recessed groove on the upper surface of the upper trim 572. The upper trim 572 may be coupled to the upper cap protrusion 553 by inserting the upper cap protrusion 553 into the upper trim hole 573.

The upper trim 572 may be coupled to the upper cap protrusion 553 to allow the door panel 570 to be tilted with respect to the door body 540 (FIG. 28). The door panel 570 may rotate while the upper trim 572 is coupled to the upper cap protrusion 553. The door panel 570 may rotate about the upper cap protrusion 553. The upper trim 572 may be coupled to the upper cap protrusion 553 to allow the door panel 570 to be parallel to the door body 540 (FIG. 31).

That is, the door panel 570 may rotate between a tilted position in which the upper trim 572 is coupled to the upper cap protrusion 553 and the door panel 570 is tilted with respect to the door body 540, and an upright position in which the upper trim 572 is coupled to the upper cap protrusion 553 and the door panel 570 is upright to be parallel to the door body 540.

The lower cap 560 may include the accommodating space 561 in which the upper trim 72 is accommodated. The front opening 562 may be formed in a front portion of the lower cap 560 to be connected to the accommodating space 561. The lower trim 580 may be accommodated in the accommodating space 561 through the front opening 562. When the door panel 570 rotates from the tilted position to the upright position, the lower trim 580 may be accommodated in the accommodating space 561 through the front opening 562.

The lower opening 563 connected to the accommodating space 561 may be formed in a lower portion of the lower cap 560. The fixer 590 may be coupled to the upper portion of the lower cap 560. Particularly, the fixer 590 may be coupled to the lower portion of the lower cap 560 to cover the lower opening 563. The fixer 590 may be coupled to the lower opening 563.

The fixer 590 may include rotation protrusions 591 provided to form a rotation axis R of the fixer 590. The rotation protrusions 591 may protrude from the left and right sides of the fixer 590. When the fixer 590 is mounted on the lower cap 560, the rotation axis R of the fixer 590 may be formed in the left and right directions of the door body 540 (FIG. 27). The rotation protrusions 591 may be rotatably accommodated in rotation protrusion accommodating holes 564 formed in the lower cap 560.

The fixer 590 may include a locking protrusion 592 for coupling with the lower trim 580. The locking protrusion 592 may protrude upward from a front portion of the fixer 590. The locking protrusion 592 may be located in front of the rotation axis R. The lower trim 580 may include a lower trim hole 581 into which the locking protrusion 592 is inserted. The fixer 590 may be coupled to the lower trim 580 by inserting the locking protrusion 592 into the lower trim hole 581.

The fixer 590 may rotate about the rotation axis R. The fixer 590 may rotate between the unlocked position P1 and the locked position P2. FIG. 29 illustrates an example in which the fixer 590 is in the unlocked position P1. FIG. 30 illustrates an example in which the fixer 590 is in the locked position P2.

When the door panel 570 rotates from the tilted position to the upright position, the fixer 590 may rotate from the unlocked position P1 to the locked position P2. Accordingly, the locking protrusion 592 of the fixer 590 may be inserted into the lower trim hole 581 of the lower trim 580. The locking protrusion 592 may be inserted into the lower trim hole 581 from bottom to top. The fixer 590 may be coupled to the lower trim 580 by inserting the locking protrusion 592 into the lower trim hole 581. By coupling the fixer 590 to the lower trim 580, the lower end of the door panel 570 may be coupled to the lower end of the door body 540.

Particularly, when the door panel 570 rotates from the tilted position to the upright position, the fixer 590 may be pressed by the lower trim 580, and thus the fixer 590 may rotate from the unlocked position P1 to the locked position P2. That is, the fixer 590 may rotate by the pressure of the lower trim 580. As the lower trim 580 presses a point of the fixer 590 that is spaced apart from the rotation axis R of the fixer 590, the fixer 590 may rotate about the rotation axis R.

The fixer 590 may include an arm 594 configured to be pressed by the lower trim 580. The arm 594 may protrude upward from a portion of the fixer 590. The arm 594 may be formed to extend radially outward from the rotation axis R. The arm 594 may be disposed behind the locking protrusion 592. The arm 594 may be pressed by the lower trim 580 when the lower trim 580 enters the accommodating space 561 and, conversely, the arm 594 may press the lower trim 580 when the fixer 590 rotates from the locked position P2 to the unlocked position P1.

The fixer 590 may include a pressing portion 598 provided to be pressed by a user. The pressing portion 598 may be formed on a lower surface of the rear portion of the fixer 590. The pressing portion 598 may be formed behind the rotation axis R. When an external force is applied to the pressing portion 598 from bottom to top, the fixer 590 may rotate. Particularly, when an external force is applied to the pressing portion 598 from bottom to top, the fixer 590 may rotate from the locked position P2 to the unlocked position P1.

An operation of coupling the door panel 570 to the door body 540 will be briefly described with reference to FIGS. 28 to 31.

The fixer 590 may be moved to the unlocked position P1 to allow the fixer 590 to be inserted into the accommodating space 561.

As illustrated in FIG. 28, the upper trim 572 may be coupled to the upper cap protrusion 553 to allow the door panel 570 to be tilted with respect to the door body 540. By inserting the upper cap protrusion 553 into the upper trim hole 573, the upper cap protrusion 553 may be coupled to the upper trim 572.

As illustrated in FIG. 29, the door panel 570 may rotate from the tilted position, in which the upper trim 572 is coupled to the upper cap protrusion 553 and the door panel 570 is tilted with respect to the door body 540, to the upright position in which the upper trim 572 is coupled to the upper cap protrusion 553 and the door panel 570 is upright to be parallel to the door body 540. That is, the door panel 570 may rotate about the upper cap protrusion 553 while the door panel 570 is coupled to the upper cap protrusion 553.

When the door panel 570 rotates from the tilted position to the upright position, the fixer 590 may rotate from the unlocked position P1 to the locked position P2 by being pressed by the lower trim 580. Particularly, when the door panel 570 rotates from the tilted position to the upright position, the arm 594 of the fixer 590 may be pressed by the lower trim 580 and thus the fixer 590 may rotate.

As illustrated in FIG. 30, when the door panel 570 rotates from the tilted position to the upright position, the fixer 590 may rotate from the unlocked position P1 to the locked position P2 and thus the fixer 590 may be coupled to the lower trim 580. The fixer 590 may be coupled to the lower trim 580 by inserting the locking protrusion 592 of the fixer 590 into the lower trim hole 581 of the lower trim 580.

As illustrated in FIG. 31, when the fixer 590 is coupled to the lower trim 580, the upper trim 572 may be coupled to the upper cap protrusion 553, and the door panel 570 may be in the upright position. The door panel 570 may be coupled to the door body 540 as the upper trim 572 is coupled to the upper cap protrusion 553 and the fixer 590 is coupled to the lower trim 580.

As mentioned above, the door panel 570 may be easily coupled to the door body 540 simply by rotating the door panel 570 after coupling the upper trim 572 to the upper cap protrusion 553. In addition, because the fixer 590 is coupled to the door body 540, the fixer 590 may be stored and transported together with the door body 540. Accordingly, it is possible to prevent the loss of the fixer 590 and to easily manage the fixer 590.

An operation of separating the door panel 570 from the door body 540 will be described with reference to FIG. 32.

In a state in which the door panel 570 is coupled to the door body 540, the fixer 590 may be in the locked position P2. When an external force is applied from a user to the pressing portion 598 of the fixer 590, the fixer 590 may rotate from the locked position P2 to the unlocked position P1 about the rotation axis R. The arm 594 of the fixer 590 may press the lower trim 580 as the fixer 590 rotates from the locked position P2 to the unlocked position P1. The lower trim 580 may be pressed by the arm 594 and separated from the accommodating space 561. The door panel 570 may rotate from the upright position to the tilted position.

As mentioned above, the lower trim 580 may be separated from the accommodating space 561 simply by pressing the fixer 590, and thus the door panel 570 may rotate from the upright position to the tilted position. Accordingly, the door panel 570 may be easily separated from the door body 540. That is, the door panel 570 may be disassembled from the door body 540 without using a separate tool.

The fixer 590 may include position fixing protrusions 595 provided to fix the position of the fixer 590 (FIG. 27). The position fixing protrusions 595 may protrude from the left and right portions of the fixer 590. The position fixing protrusion 595 may be formed behind the rotation axis R. That is, the position fixing protrusion 595 may protrude to the left and right from the rear portion of the fixer 590. However, according to embodiments, the fixer 590 may include a single position fixing protrusion provided to protrude from either the left side or the right side of the fixer 590.

The lower cap 560 may include a locking hole 565 into which the position fixing protrusion 595 is coupled to allow the fixer 590 to be fixed to the locked position P2. The lower cap 560 may include an unlocking hole 566 into which the position fixing protrusion 595 is coupled to allow the fixer 590 is fixed to the unlocked position P1. The lower cap 560 may include a guide passage 567 formed to guide the movement of the position fixing protrusion 595 between the locking hole 565 and the unlocking hole 566.

With this structure, the position fixing protrusion 595 may be coupled to the locking hole 565, thereby preventing the door panel 570 from being unintentionally separated from the door body 540. That is, the door panel 570 may be stably maintained in a state of being coupled to the door body 540.

In addition, before coupling the door panel 570 to the door body 540, the position fixing protrusion 595 may be coupled to the unlocking hole 566. Accordingly, it is possible to prevent the interference with the locking protrusion 592 in a process in which the lower trim 580 is inserted into the accommodating space 561.

The present disclosure may not be applied to the above-described refrigerator and the door thereof, but also be applied equally to home appliances including a main body including a cavity corresponding to an inner space for performing a certain function and a door configured to open and close the cavity, and the door thereof.

For example, the present disclosure may be applied to a cooking appliance including a cooking chamber, a dishwasher including a washing chamber, a dryer including a drying chamber, a clothes treating apparatus including a clothing treating chamber, an air conditioner including a heat exchange chamber in which a heat exchanger is disposed, etc.

According to the present disclosure, the refrigerator may include a main body including a storage compartment, and a door configured to open and close the storage compartment. The door may include a door body including a door outer plate, a door inner plate, a first cap coupled to one end of the door outer plate, and a second cap coupled to the other end of the door outer plate, a door panel configured to be detachably coupled to a front surface of the door body, the door panel including a panel, a first trim protruding from one end of a rear surface of the panel, and a second trim protruding from the other end of the rear surface of the panel, and a fixer disposed on the first cap to be rotatable between an unlocked position and a locked position. The first cap may include an accommodating space and a front opening formed in a front portion of the first cap and connected to the accommodating space. The second trim may be coupled to the second cap. The first trim may be accommodated in the accommodating space of the first cap through the front opening of the first cap. The fixer may rotate from the unlocked position to the locked position by pressure of the first trim while the first trim is being inserted into the accommodating space of the first cap through the front opening of the first cap, and then the fixer may be coupled to the first trim.

The fixer may include a locking protrusion, and the first trim may include a first trim hole. The fixer may be coupled to the first trim as the locking protrusion is inserted into the first trim hole.

The second trim may include a second trim hole, and the second cap may include a cap protrusion. The second trim may be coupled to the second cap as the cap protrusion is inserted into the second trim hole.

The fixer may include an arm configured to be pressed by the first trim or configured to press the first trim.

The fixer may include rotation protrusions provided to form a rotation axis of the fixer. The rotation axis may be formed along a left and right direction of the door body.

The fixer may include a position fixing protrusion provided to fix a position of the fixer. The first cap may include a locking hole into which the position fixing protrusion is coupled to allow the fixer to be fixed to the locked position, and an unlocking hole into which the position fixing protrusion is coupled to allow the fixer to be fixed to the unlocked position.

The first cap may include a guide passage formed to guide movement of the position fixing protrusion between the locking hole and the unlocking hole.

The position fixing protrusion may include a plurality of elastic parts formed along a circumferential direction of a central axis of the position fixing protrusion. A plurality of slits may be formed between the plurality of elastic parts.

In response to the position fixing protrusion being in the guide passage, the plurality of elastic parts may be elastically deformed radially inward, and in response to the position fixing protrusion being in the locking hole or the unlocking hole, the plurality of elastic parts may be elastically restored.

The door panel may be configured to rotate between a tilted position in which the second trim is coupled to the second cap and the door panel is tilted with respect to the door body, and an upright position in which the second trim is coupled to the second cap and the door panel is upright to be parallel to the door body.

As the fixer is pressed by the first trim and rotates from the unlocked position to the locked position in response to the door panel rotating from the tilted position to the upright position, the fixer may be coupled to the upper trim.

In response to the fixer rotating from the locked position to the unlocked position, the door panel may be configured to rotate from the upright position to the tilted position by pressure of the fixer.

The first cap may include an upper cap coupled to an upper end portion of the door outer plate. The second cap may include a lower cap coupled to a lower end portion of the door outer plate. The first trim may include an upper trim protruding from an upper end portion of the rear surface of the panel. The second trim may include a lower trim protruding from a lower end portion of the rear surface of the panel. The fixer may be coupled to the upper cap.

The upper cap may include an upper cap body including the accommodating space and the front opening, and a cap cover coupled to an upper end of the upper cap body. The fixer may be coupled to the cap cover of the upper cap.

The first cap may include a lower cap coupled to a lower end portion of the door outer plate. The second cap may include an upper cap coupled to an upper end portion of the door outer plate. The first trim may include a lower trim protruding from a lower end portion of the rear surface of the panel. The second trim may include an upper trim protruding from an upper end portion of the rear surface of the panel. The fixer may be coupled to the lower cap.

According to the present disclosure, a refrigerator may include a main body including a storage compartment, and a door configured to open and close the storage compartment. The door may include a door body including an upper cap and a lower cap including a lower cap protrusion, a door panel configured to be detachably coupled to a front surface of the door body, and including an upper trim and a lower trim, a fixer disposed on the upper cap to be rotatable between an unlocked position and a locked position, and an elastic member configured to elastically bias the fixer to the locked position.

The lower trim may be coupled to the lower cap protrusion to allow the door panel to be tilted with respect to the door body.

The door panel may be configured to rotate between a tilted position in which the lower trim is coupled to the lower cap protrusion and the door panel is tilted with respect to the door body, and an upright position in which the lower trim is coupled to the lower cap protrusion and the door panel is upright to be parallel to the door body.

As the fixer rotates from the unlocked position to the locked position by an elastic force of the elastic member in response to the door panel rotating from the tilted position to the upright position, the fixer may be coupled to the upper trim.

The fixer may include a pressing portion configured to apply an external force to the fixer to allow the fixer to rotate from the locked position to the unlocked position.

As the fixer rotates from the locked position toward the unlocked position by the external force applied to the pressing portion, an elastic force may be accumulated in the elastic member. When the external force acting on the fixer is removed, the fixer may rotate from the unlocked position to the locked position by the elastic force accumulated in the elastic member.

The fixer may include an inclined surface. As the inclined surface is pressed by the upper trim when the door panel rotates from the tilted position to the upright position, the fixer may rotate from the locked position to the unlocked position.

According to the present disclosure, a refrigerator may include a main body including a storage compartment, and a door configured to open and close the storage compartment. The door may include a door body including an upper cap and a lower cap, a door panel configured to be detachably coupled to a front surface of the door body, and including an upper trim and a lower trim configured to be coupled to the lower cap, and a fixer disposed on the upper cap to be rotatable between a locked position coupled to the upper trim and an unlocked position disengaged from the upper trim. The fixer may include a position fixing protrusion configured to be coupled to a locking hole formed in the upper cap to allow the fixer to be fixed to the locked position.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body including a storage compartment; and a door to open and close the storage compartment, the door including:

a door body including:

a door outer plate, a door inner plate, a first cap coupled to a first end of the door outer plate, and including:

a front opening in a front portion of the first cap providing an entry to an accommodating space provided by the first cap, and a groove defining a locking hole and an unlocking hole, and a second cap coupled to a second end of the door outer plate, a door panel detachably mountable on the door body, and including:

a panel, a first trim protruding from a first end of a rear surface of the panel, and a second trim protruding from a second end of the rear surface of the panel, and a fixer on the first cap and including a position fixing protrusion protruding from a side of the fixer, the fixer rotatable between an unlocked position where the position fixing protrusion is engaged in the unlocking hole and fixes the fixer in the unlocked position and a locked position where the position fixing protrusion is engaged in the locking hole and fixes the fixer in the locked position, wherein the door body, the door panel, and the fixer are configured such that, to mount the door panel on the door body:

the second trim is couplable to the second cap, and with the second trim coupled to the second cap and the fixer being in the unlocked position, the first trim is passable through the front opening to be inserted into the accommodating space and, while being inserted into the accommodating space, the first trim presses the fixer, thereby rotating the fixer to engage the position fixing protrusion into the locking hole, such that the fixer is in the locked position and the fixer is coupled to the first trim.

2. The refrigerator of claim 1, wherein
the first trim includes a first trim hole,
the fixer includes a locking protrusion, and
the door body, the door panel, and the fixer are configured so that, to mount the door panel on the door body:
the locking protrusion is insertable into the first trim hole, and
while the locking protrusion is being inserted into the first trim hole, the fixer is coupled to the first trim.

3. The refrigerator of claim 1, wherein
the second trim includes a second trim hole,
the second cap includes a cap protrusion, and
the door body, the door panel, and the fixer are configured so that, to mount the door panel on the door body:
the cap protrusion is insertable into the second trim hole, and
the second trim is coupled to the second cap as the cap protrusion is inserted into the second trim hole.

4. The refrigerator of claim 1, wherein
the fixer comprises an arm, and
the door body, the door panel, and the fixer are configured so that,
to mount the door panel on the door body:
the first trim presses the arm while being inserted into the accommodating space, thereby rotating the fixer to the locked position, so that the fixer is coupled to the first trim, and
to separate the door panel from the door body:
the fixer is rotatable from the locked position to the unlocked position to cause the arm to press the first trim, thereby removing the first trim from being accommodated in the accommodating space, so that the fixer is decoupled from the first trim and the door panel is thereby separated from the door body.

5. The refrigerator of claim 1, wherein
the fixer includes rotation protrusions to form a rotation axis of the fixer,
the rotation axis is formed along a left and right direction of the door body, and
the fixer rotates about the rotation axis when the fixer is rotated between the locked position and the unlocked position.

6. The refrigerator of claim 1, wherein
the position fixing protrusion is configured to be:
movable into the unlocking hole to fix the fixer in the unlocked position, and
movable into the locking hole to fix the fixer in the locked position, and
the door body, the door panel, and the fixer are configured so that,
to mount the door panel on the door body:
the position fixing protrusion is moved into the unlocking hole to fix the fixer in the unlocked position before the first trim presses the fixer.

7. The refrigerator of claim 6, wherein
the first cap includes a guide passage, and
the door body, the door panel, and the fixer are configured so that, to mount the door panel on the door body:
a movement of the position fixing protrusion is guided along the guide passage while the first trim presses the fixer and the fixer is rotated from the unlocked position to the locked position.

8. The refrigerator of claim 7, wherein
the position fixing protrusion includes a plurality of elastic parts along a circumferential direction of the position fixing protrusion, and
a plurality of slits arranged so that each slit of the plurality of slits is between adjacent elastic parts of the plurality of elastic parts.

9. The refrigerator of claim 8, wherein
in response to the position fixing protrusion being moved into the guide passage, one or more elastic parts of the plurality of elastic parts is elastically deformed radially inward, and
in response to the position fixing protrusion being moved into the locking hole or the unlocking hole, the one or more elastic parts of the plurality of elastic parts is elastically restored.

10. The refrigerator of claim 1, wherein
with the second trim coupled to the second cap, the door panel is configured to rotate between:
a tilted position in which the door panel is tilted with respect to the door body, and
an upright position in which the first trim is inserted into the accommodating space, the fixer is rotated to the locked position and is coupled to the first trim, and the door panel is fixed to the door body.

11. The refrigerator of claim 10, wherein
the door body, the door panel, and the fixer are configured so that, to mount the door panel on the door body:
with the second trim coupled to the second cap and the fixer being in the unlocked position,
the door panel is rotatable from the tilted position to the upright position so that:
with the door panel being rotated from the tilted position to the upright position, the first trim is being inserted into the accommodating space, the first trim presses the fixer, thereby rotating the fixer to the locked position, so that the fixer is coupled to the first trim.

12. The refrigerator of claim 10, wherein
the door body, the door panel, and the fixer are configured so that, to separate the door panel from the door body:
with the second trim coupled to the second cap,
the fixer is rotatable from the locked position to the unlocked position so that:
with the fixer being rotated from the locked position to the unlocked position, the door panel is pressed by the fixer, the first trim is removed from the accommodating space and decoupled from the fixer, and the door panel is rotated from the upright position to the tilted position.

13. The refrigerator of claim 1, wherein
the first end of the door outer plate includes an upper end portion of the door outer plate,
the second end of the door outer plate includes a lower end portion of the door outer plate,
the first end of a rear surface of the panel includes an upper end portion of the rear surface of the panel,
the second end of a rear surface of the panel includes a lower end portion of the rear surface of the panel, and
the fixer is coupled to the first cap.

14. The refrigerator of claim 13, wherein
the first cap includes a first cap body which includes the front opening and provides the accommodating space, and a first cap cover coupled to an upper end of the first cap body, and
the fixer is coupled to the first cap cover.

15. The refrigerator of claim 1, wherein the first end of the door outer plate includes a lower end portion of the door outer plate, the second end of the door outer plate includes an upper end portion of the door outer plate, the first end of a rear surface of the panel includes a lower end portion of the rear surface of the panel, and the second end of a rear surface of the panel includes an upper end portion of the rear surface of the panel, and the fixer is coupled to the first cap.

* * * * *